US007331381B2

(12) United States Patent
Wang et al.

(10) Patent No.: US 7,331,381 B2
(45) Date of Patent: Feb. 19, 2008

(54) HYBRID HEAT EXCHANGERS

(75) Inventors: Jinliang Wang, Los Angeles, CA (US); Wei-Teh Shih, Yorba Linda, CA (US)

(73) Assignee: Allcomp, Inc., City of Industry, CA (US)

( * ) Notice: Subject to any disclaimer, the term of this patent is extended or adjusted under 35 U.S.C. 154(b) by 130 days.

(21) Appl. No.: 11/356,337

(22) Filed: Feb. 16, 2006

(65) Prior Publication Data

US 2007/0284095 A1 Dec. 13, 2007

(51) Int. Cl.
*F28F 3/06* (2006.01)

(52) U.S. Cl. ..... 165/166; 165/170; 165/905

(58) Field of Classification Search ..... 165/164, 165/166, 167, 168, 170, 905
See application file for complete search history.

(56) References Cited

U.S. PATENT DOCUMENTS 4,356,678 A 11/1982 Andrews et al.
4,437,217 A 3/1984 Lallaye et al.
4,545,429 A 10/1985 Place, Jr. et al.
4,982,784 A 1/1991 Rhodes
5,042,565 A 8/1991 Yuen et al.
5,105,540 A 4/1992 Rhodes
5,626,188 A 5/1997 Dewar et al.
5,628,363 A 5/1997 Dewar et al.
5,778,033 A * 7/1998 Filipuzzi et al. ..... 165/168
5,845,399 A 12/1998 Dewar et al.
6,261,485 B1 7/2001 Klett
6,267,175 B1 7/2001 Anderson
6,287,375 B1 9/2001 Klett
6,344,159 B1 2/2002 Klett
6,399,149 B1 6/2002 Klett et al.
6,482,485 B1 * 11/2002 Pichon ..... 165/169
6,780,505 B1 8/2004 Klett et al.
6,888,720 B2 5/2005 Pfister et al.
2001/0047862 A1 * 12/2001 Anderson et al. ..... 165/170
2003/0162007 A1 8/2003 Klett et al.
2003/0175201 A1 9/2003 Klett et al.
2003/0232463 A1 12/2003 Davidson
2006/0157234 A1 * 7/2006 Golecki ..... 165/170
2007/0084593 A1 * 4/2007 Beasant ..... 165/167

OTHER PUBLICATIONS

U.S. Appl. No. 11/355,874, filed Feb.16, 2006, Shih, Unpublished.

(Continued)

*Primary Examiner*—Teresa J. Walberg
(74) *Attorney, Agent, or Firm*—Knobbe, Martens, Olson & Bear, LLP

(57) ABSTRACT

A light weight hybrid heat exchanger core possessing low density and improved thermal conductivity is disclosed. The hybrid core is comprised of a plurality of parting sheets and interposed by a plurality of high thermal conductivity, light weight bridging elements and enclosure bars. These core members are comprised of dissimilar materials. The parting sheets and bridging elements are interconnected by a specially tailored joint which forms form a substantially strong, high thermal conductivity bond. In particular embodiments, carbon-based bridging elements are bonded to metallic parting sheets using a brazed joint. The parting sheets, in certain embodiments, may comprise titanium or Ni-based superalloys or carbon composites, while the carbon-based bridging elements may comprise fiber-reinforced composites. The carbon-based bridging elements reduce the core weight and increase the core thermal conductivity over conventional all-metal designs, while the brazed joint provides for improved leak resistance over all-composite designs.

20 Claims, 22 Drawing Sheets

OTHER PUBLICATIONS

Gallego, Nidia et al., "Carbon Foam for Cooling Power Electronics", Propulsion Materials, 2004, pp. 17-21, available at http://www.oml.gov/sci/apm/documents/PEProj_Carbon_Foam_For_Power_04.pdf prior to the filing date of the present application.

Klett, Dr. James, "High Thermal Conductivity Carbon Foams for Fuel Cell Radiators" Oak Ridge National Laboratory, Cimtech, Carbon and Insulation Materials Technology Group, 13 pgs, available at http://www.pnl.gov/microcats/ottreview/ottmeeting/17-Klett.pdf prior to the filing date of the present application.

Klett, James, et al., "Heat Exchangers/Radiators Utilizing Graphite Foams", Oak Ridge National Laboratory, U.S. Department of Energy, Jun. 16, 2001, 14 pgs, available at http://www.ms.oml.gov/researchgroups/CMT/foam/heat%20sinks.pdf prior to the filing date of the present application.

* cited by examiner

600

HYBRID HEAT EXCHANGERS

GOVERNMENT FUNDING

This invention was made with government support under Contract NNC04C73C and NNC05CA15C awarded by U.S. National Aeronautics and Space Administration. The Government has certain rights in the invention.

BACKGROUND OF THE INVENTION

1. Field of the Invention

Embodiments of the present invention relate to heat exchangers and, in particular, to hybrid heat exchangers and cores used to build such heat exchangers.

2. Description of the Related Art

Heat exchangers are engineering devices that have found widespread utility in applications such as refrigeration, air conditioning, power production, and chemical processing. Heat exchangers are often used in machines and industrial processes, wherein the core of the heat exchanger facilitates transfer of heat from one fluid to another in order to perform functions such as cooling or heat recovery.

In one embodiment, a heat exchanger core includes a series of parting sheets which are stacked upon each other. Each parting sheet is separated from its neighbors to form a fluid flow passageway. In operation of the heat exchanger, hot and cold fluids are passed through the core in adjacent passageways and heat from the hot fluid is transferred to the cold fluid by conduction of heat through the parting sheet. Bridging elements are often interconnected to the two plates within the fluid flow passageways as well. These elements are in thermal communication with the plates and increase the surface area of the heat exchanger in contact with the two fluids. In this manner, the bridging elements also transfer heat by conduction through the bridging element to the parting sheet and subsequently to the cold fluid or to the cold fluid directly. An example of a heat exchanger is the automobile radiator, where a first fluid, hot coolant, is contained within the body of the radiator and a second fluid, ambient air, is blown past the surface of the radiator. The radiator body functions as a parting sheet, receiving heat from the hot coolant and transferring it to the relatively cool, flowing air.

To perform this heat transfer function, the core is subject to several performance requirements. These include heat transfer between the fluids, mechanical strength to support internal pressures from fluid flow and thermal stresses induced at operating temperatures, and substantially little leakage of the fluids. Aerospace and military industry applications further demand lower weight and more efficient heat transfer. For example, little to no leakage is allowed in land-based heat exchangers, while substantially all space bound heat exchangers operated under vacuum do not allow any leakage.

In traditional high temperature heat exchanger design, all-metal fabrications have been used to meet these demands. Metal fabrications, however, possess inherent limitations which are problematic for the more demanding aerospace and military applications. For example, while aluminum is light weight and possesses excellent thermal conductivity, it is limited to applications below approximately 500° F. because of softening above this temperature. Similarly, while Ni- or Fe-based alloys are often utilized for higher temperature applications, in the range of 700-1100° F., these alloys are heavy and exhibit low thermal conductivity, resulting in high weight and low thermal effectiveness. Furthermore, metals possess a relatively high coefficient of thermal expansion (CTE), resulting in high thermal stresses between different members of the heat exchanger which are typically operated at different temperatures. Additionally, metals are subject to corrosion in aggressive environments, which limits the durability and lifetime of all-metal heat exchangers From the foregoing, it is apparent that there is a need for an improved heat exchanger. In particular, there is a need for a high temperature heat exchanger with improved heat transfer and leak tight which further possesses reduced weight.

SUMMARY OF THE INVENTION

The aforementioned needs are satisfied in certain embodiments by a heat exchanger core which, in one embodiment, comprises a plurality of parting sheets and one or more carbon-based bridging elements. The heat exchanger core in one embodiment may be a hybrid heat exchanger core with metallic parting sheets and the one or more carbon-based bridging elements. The metallic parting sheets may be separated by a predetermined distance and oriented substantially parallel to each other to define a fluid flow passageway. In one embodiment, metallic enclosure bars are adapted to span the separation between the parting sheets and interconnect the parting sheets. In this fashion, the enclosure bars reinforce the hybrid heat exchanger core, enhancing the mechanical durability of the hybrid core.

In certain embodiments, the heat exchanger core also comprises a plurality of low density, high thermal conductivity, carbon-based bridging elements. The bridging elements are adapted to be positioned between the parting sheets and further interconnect the parting sheets. In this manner, the carbon-based bridging elements define fluid flow channels and increase the area of the heat exchanger in contact with hot and cold fluids flowing through the core. These carbon-based bridging elements transfer heat more efficiently from the hot fluids to cold fluids than metal bridging elements under identical conditions and further reduce the core weight compared to all-metal fabrications.

The metallic enclosure bars and the carbon-based bridging elements may interconnect the parting sheets using a plurality of brazed joints. The brazed joints are comprised of a metallic braze alloy which is specially formulated to melt at temperatures lower than that of the parting sheets and bridging elements and, in the molten state, wet the joint surfaces and form a continuous film over the surface of the joint area that substantially fills all open voids within the materials. Advantageously, when solidified, the brazed joints form a strong bond and also inhibit leaks between the enclosure bar and parting sheets.

In a particular embodiment, a hybrid heat exchanger core comprises a plurality of substantially parallel metallic parting sheets possessing a first face and a second face, wherein opposing faces of the metallic parting sheets are separated by a span which defines a passageway for fluid flow, and a rigid carbon-based bridging element interposed within the span between adjacent metallic parting sheets. The carbon-based bridging element is joined to the metallic parting sheet with a brazed joint, which forms a mutual contact between the metallic parting sheet and the carbon-based bridging element in order to mechanically secure the metallic parting sheet to the carbon-based bridging element.

In another embodiment, a hybrid heat exchanger core comprises a plurality of metallic parting sheets possessing a first face and a second face and arranged substantially parallel to one another. A plurality of carbon/carbon composite fins are provided between adjacent metallic parting sheets. The fins are oriented substantially perpendicular or at an angle to the adjacent metallic parting sheets and define channels between the fins for fluid passage. In certain embodiments, the fibers of the composite are oriented substantially perpendicular to the parting sheets. In this manner, heat transfer between the composite and the parting sheets is increased while thermal mismatch stresses are reduced, enhancing the performance of the hybrid heat exchanger core.

In another particular embodiment, a heat exchanger core comprises a plurality of parting sheets possessing a first face and a second face arranged substantially parallel to one another and a reticulated vitreous carbon-based foam which is provided between adjacent parting sheets. The parting sheets in this embodiment may be made of metal or other materials, such as carbon/carbon composites.

In another embodiment, a heat exchanger core comprises a plurality of parting sheets possessing a first face and a second face arranged substantially parallel to one another. A carbon-based foam core is provided between adjacent parting sheets having a density between about 0.1-0.5 g/cm$^3$, a thermal conductivity of about 10-150 W/m K, and an open porosity of 80% or more.

In another embodiment, a foam comprises a carbon-based foam. The carbon foam is a reticulated vitreous carbon foam with carbon ligaments and a carbon layer deposited onto the carbon ligaments.

Hence, preferred embodiments of the invention described herein provides for a heat exchanger possessing low density, high thermal conductivity, as well as leak-resistance and improved reliability. These and other objects and advantages will become more apparent from the following description taken in conjunction with the accompanying drawings.

DETAILED DESCRIPTION OF THE PREFERRED EMBODIMENTS

Preferred embodiments of the present invention relate to heat exchanger cores and heat exchangers made with the same. The heat exchangers described herein are applicable to aerospace, energy, military and other related industries. Heat exchanger cores serve as the unit cells or building blocks for a heat exchanger, and preferably possess high thermal conductivity, with sufficient structural integrity to withstand operational loading and thermal stress, and allow for flow of fluid with minimal leakage, restriction to flow or pressure drop. As described herein, heat exchangers are devices that are used to transfer thermal energy between two or more fluids, between solid surfaces and a fluid, or between solid particulates and a fluid, where each is in thermal communication with the other and may be at a different temperature. Furthermore, the heat exchanger may be utilized in a closed system, where the heat transfer fluids are contained in a closed system or an open system, where the heat transfer fluid is part of a larger environment. Preferred heat exchanger cores may comprise metal-based parting plates and carbon-based materials in the core of the heat exchanger. The carbon-based core is preferably joined to the parting sheets using brazing, or other techniques such as adhesives and soldering, to provide for a heat exchanger possessing relatively high thermal conductivity and heat transfer. Although the heat exchangers are described particularly utilizing a carbon-based composite core and metal parting sheets, other configurations and combinations of materials are also contemplated. In particular, other high conductivity, low density carbon-based materials may be used in the core.

Figure 1:
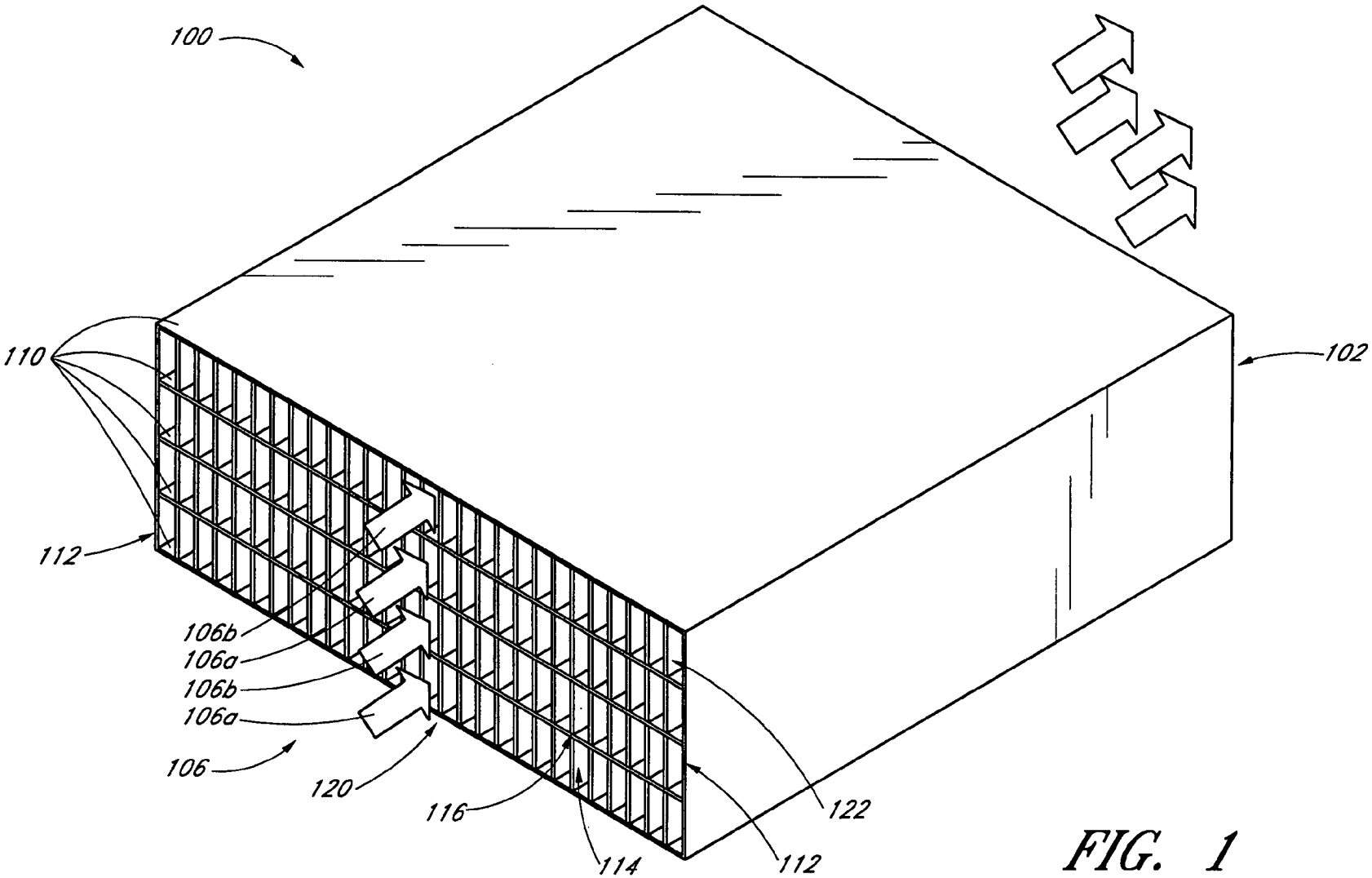
FIG. 1 is a perspective view of a multi-layer heat exchanger.

FIG. 1 illustrates a perspective view of one embodiment of a hybrid heat exchanger core 100, comprising a multi-layer hybrid core 102. Generally, the hybrid core 100 is designed to enhance heat transfer between fluids 106*a*, 106*b* flowing through the hybrid core 100 while reducing the weight of the hybrid core 100 over conventional designs. These goals are accomplished by a hybrid core 100 which utilizes a combination of dissimilar materials, comprising a plurality of parting sheets 110 which sandwich a plurality of enclosure bars 112 and a plurality of bridging elements 114, which are in turn interconnected by a plurality of joints 116. The parting sheets 110 and enclosure bars 112 are designed, in part, to frame and mechanically reinforce the hybrid heat exchanger 100, containing the flow of a hot fluid 106*a* and a cold fluid 106*b* (collectively referred to as fluids 106). The parting sheets 110 also conduct heat between the fluids 106. The bridging elements 114 possess high thermal conductivity and low density in order to increase the heat transferred between the fluids 106 while also lowering the weight of the hybrid core 100. In some embodiments, the joints 116 are particularly designed to interconnect and hermetically seal the enclosure bars 112 to the parting sheets 110, inhibiting rupture and pressure drops within the hybrid core 100, as well as inhibiting leakage and cross-contamination of the fluids 106.

In the embodiment of FIG. 1, the parting sheets 110, bridging elements 114, and enclosure bars 112 (110, 114, and 112 collectively referred to as the core members 120) are in contact with the fluids 106 flowing through the hybrid core 100. Hot and cold fluids 106*a* and 106*b* flow within layers 122 defined by the parting sheets 110. The core members 120 in contact with the hot fluid 106*a*, which has a temperature greater than that of the core members 120, receive heat from the hot fluid 106*a* by thermal convection, raising the temperature of these core members 120. The core members 120 in contact with the cold fluid 106*b*, which has a temperature less than the core members 120, give heat to the cold fluid 106*b* by thermal convection, lowering the temperature of these core members 120. Heat is further conducted through the core members 120 from areas of high temperature to areas of low temperature, cooling the core members 120 at high temperature and heating the core members 120 at low temperature. Thus, the core members 120 act as conduits for heat transfer between the hot and cold fluids 106*a* and 116*b*, cooling the hot fluid 106*a* and heating the cold fluid 106*b*. External pressure maintains a steady flow of hot and cold fluids 106*a* and 106*b* through the hybrid core 100, which in turn maintains the flow of heat from hot fluids 106*a* to cold fluids 106*b* via the core members 120. In the multi-layer hybrid core 102, as illustrated in FIG. 1, heat transfer occurs within multiple layers 122 of the multi-layer hybrid heat exchanger 102 as hot and cold fluids 106*a* and 106*b* flow in adjacent layers 122 The operation of multi-layer heat exchangers 102 are discussed in greater detail below with respect to FIGS. 5 and 6.

Figure 2A:
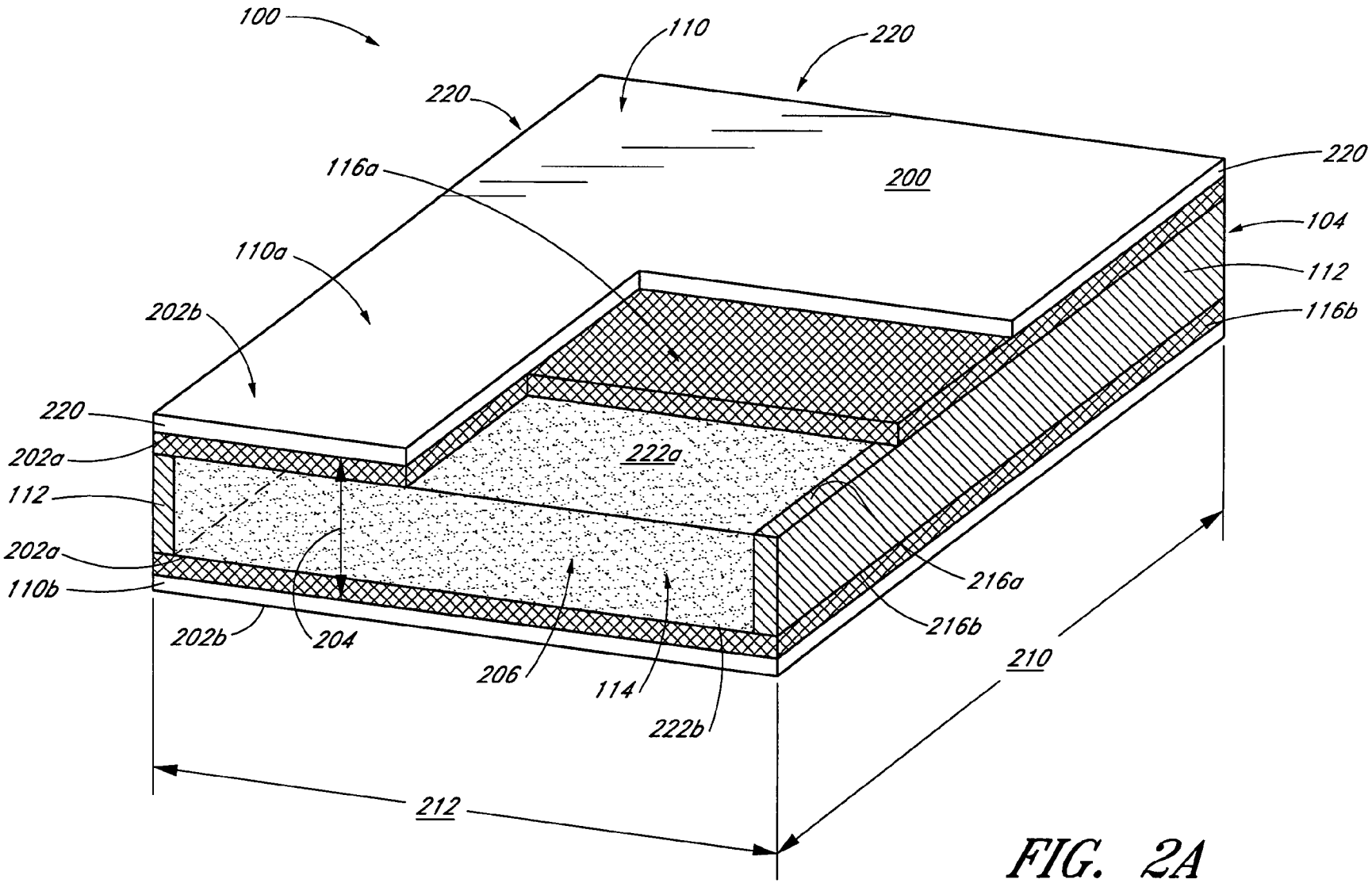
FIGS. 2A-2B are partial cut-away, perspective views of two embodiments of the heat exchanger core.
Figure 2B:
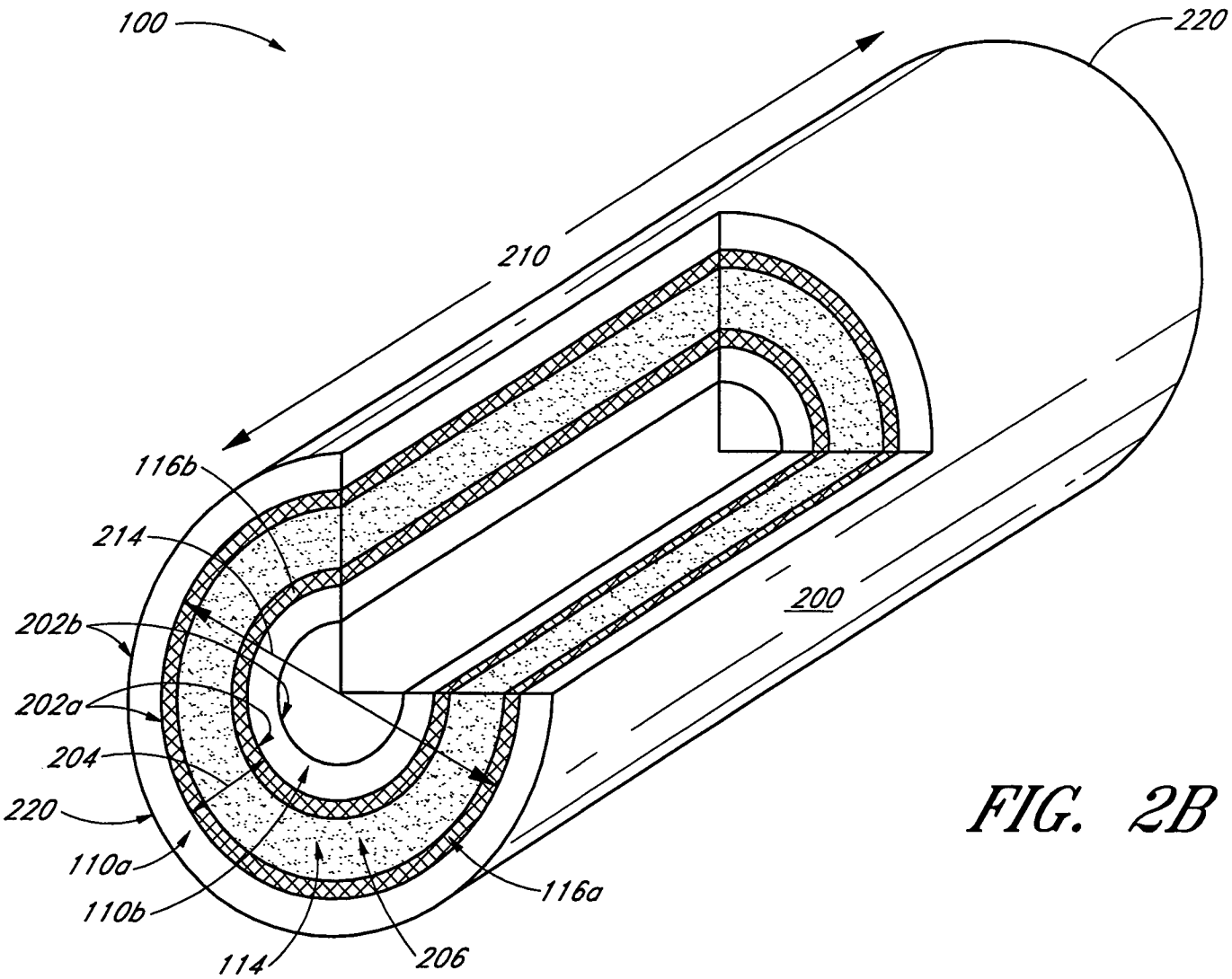

FIG. 2A is a partial cut-away view of a single-layer hybrid core 104, illustrating the core members 120. In the embodiments of FIGS. 2A-2B, the parting sheets 110 comprise a parting sheet body 200 having inner and outer faces 202*a* and 202*b*. The term sheet is used as a broad term, including its ordinary dictionary meaning as well as referring to a member that may be substantially flat (as shown in FIG. 2A) or possess bends or curves and formed to predetermined shape. The parting sheet body 200 may additionally be tubular, as shown in FIG. 2B, defining a closed surface having a substantially circular cross-section. In alternative embodiments, other cross-sectional shapes are also envisioned.

In the embodiment of FIG. 2A, the parting sheet body 200 further comprises a flat sheet. In an alternative embodiment, FIG. 2B, the parting sheet 110 comprises a hollow tube. An upper parting sheet 110*a* and a lower parting sheet 110*b* are oriented such that the inner faces 202*a* of the parting sheets 110*a* and 110*b* are substantially parallel to one another, separated by a predetermined span 204 which defines a fluid flow passageway 206. In the embodiments of FIGS. 2A-2B, the parting sheets 110*a* and 110*b* have opposing sides 220 defining a length 210 and a width 212 (FIG. 2A) or diameter 214 (FIG. 2B). The inner faces 202*a* of the parting sheets 110*a* and 110*b* are directed towards the span 204. The parting sheets 110*a* and 110*b* sandwich together the bridging elements 114 and, optionally, a plurality of enclosure bars 112, as will be discussed in greater detail below with respect to the bridging elements 114 and enclosure bars 112. An upper joint 116*a* is interposed between the upper parting sheet 110*a* and both the bridging elements 114 and the enclosure bars 112. A lower joint 116*b* is interposed between the lower parting sheet 110*b* and both the bridging elements 114 and, optionally, the enclosure bars 112.

When streams of hot fluids 106*a* and cold fluids 106*b* are introduced into the hybrid core 100, the parting sheets 110*a* and 110*b* serve both structural and thermal roles. The flowing fluids 106 are pushed at high pressure through the hybrid core 100, and in one aspect, the parting sheets 110*a* and 110*b* should contain the flowing fluids 106 without rupture. In another aspect, the parting sheets 110*a* and 110*b* should be capable of withstanding a predetermined elevated temperature without substantial deformation. Furthermore, the parting sheets 110*a* and 110*b* should support thermal stresses arising from the thermal gradients generated by contact with the hot and cold fluids 106*a* and 106*b*. Also, the parting sheets 110*a* and 110*b* should quickly transfer heat in response to temperature gradients within the parting sheets 110*a* and 110*b*.

The parting sheets 110*a* and 110*b* may be comprised of a material having suitable thermal and structural properties, as described above. In some embodiments, the parting sheets 110*a* and 110*b* can be comprised one or more materials having a relatively high thermal conductivity and strength. In particular embodiments, the parting sheet may possess low planar conductivity but high through-the-thickness conductivity so as to facilitate heat transfer between layers of the hybrid heat exchanger core 100. In some non-limiting embodiments, the parting sheets 110*a* and 110*b* may comprise high temperature metallic alloys, including, but not limited to, titanium alloys (e.g., Ti-1100) for up to 500~550° C., nickel based alloys (e.g., Inconel, HASTELLOY® metals etc.) for up to 600~650° C. Other metals having high temperature stability and strength can also be utilized. Examples include, but are not limited to Titanium and Nickel alloys such as Ti-1100, Hastelloy X. Other materials, including polymer composites and carbon/carbon composites may also be used for the parting sheets.

In the embodiment of FIG. 2A, the parting sheets 110*a* and 110*b* extend about 2 to 80 inches, more preferably about 6 to 12 inches in length 210, and about 2 to 40 inches, more preferably about 4 to 10 inches in width 212 respectively, with a thickness of approximately 4 to 20, more preferably about 10 mils. However, it will be appreciated that any suitable dimensions may be used for a desired application.

Figure 10:
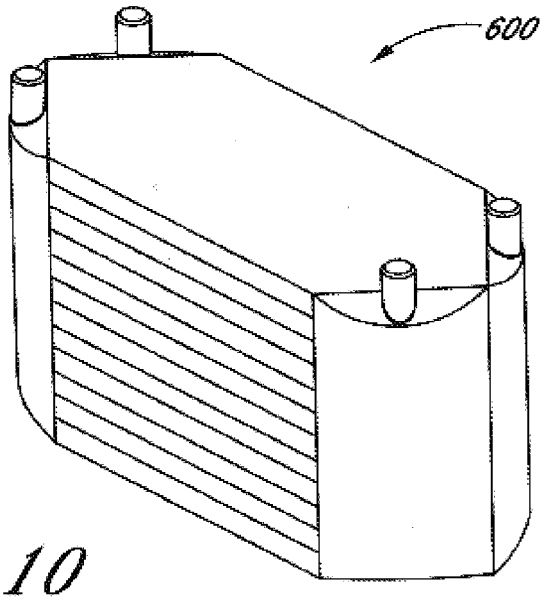
FIG. 10 illustrates a heat exchanger comprising a plurality of heat exchanger cores.
Figure 11:
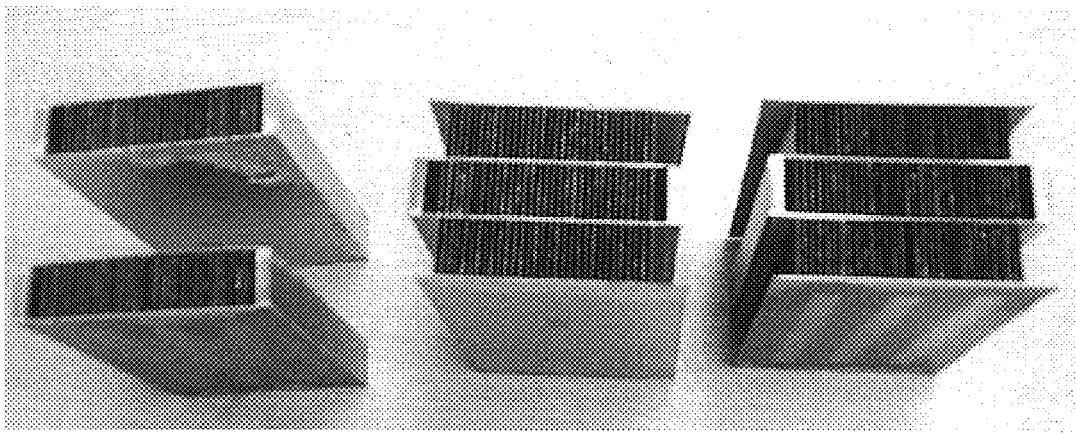
FIG. 11 illustrates single level and three level heat exchanger cores.

The embodiment in FIG. 1 illustrates a hybrid heat exchanger having 4 metallic parting sheets (i.e., a 3 layer design). It will be appreciated that heat exchangers may be provided with only 2 metallic parting sheets (i.e., a single layer heat exchanger, such as shown in FIG. 11) or 3 metallic parting sheets (e.g., a dual layer heat exchanger), or even more metallic parting sheets, for example, between 4 and 25 parting sheets. FIG. 10, for example, illustrates a heat exchanger with 12 layers.

The hybrid core 100 may further comprise a plurality of enclosure bars 112, interconnected with the parting sheets 110*a* and 110*b*, as illustrated in FIG. 2A. The enclosure bars 112 are generally elongate, extending at least a portion of the length 210 of the parting sheets 110*a* and 110*b*. The enclosure bars 112 further possess top and bottom faces 216*a* and 216*b* which are configured to mate with the inner faces 202*a* of the parting sheets 102*a* and 102*b*. Preferably, the enclosure bars 112 are dimensioned such that the top and bottom faces 216*a* and 216*b* of the enclosure bars 112 span the distance between the parting parting sheets 110*a* and 110*b* and substantially contact the inner faces 202*a* of upper and lower parting sheets 110*a* and 110*b*. The enclosure bars 112 are positioned within the span 204 of the parting sheets 110*a* and 110*b*, adjacent to the sides 220 of the parting sheets 110*a* and 110*b*. In this manner, the enclosure bars 112 may be joined to the parting sheets 110*a* and 110*b* to reinforce the hybrid core 100 as described below.

In one advantage, the enclosure bars 112 bound the fluid flow passageway 206 of the hybrid core 100. In another advantage, the faces 216*a* and 216*b* of the enclosure bar 112 provide a large joint area with which to interconnect the enclosure bars 112 to the parting sheets 110*a* and 110*b*. The joints 116 and the parting sheets 110*a* and 110*b* support a portion of the thermal and mechanical loads imposed on joints 116 and parting sheets 110*a* and 110*b*, including but not limited to internal pressures, shear stresses, and thermal stresses. Thus, the stresses experienced by the joints 116 and the parting sheets 110*a* and 110*b* are reduced, enhancing the mechanical durability of the hybrid core 100. The enclosure bar 112 may be fabricated from the same material as the parting sheets 110*a* and 110*b*. In one embodiment, the enclosure bars 112 may have a thickness of about 1/16 to 1/4 of an inch, more preferably about 1/8 of an inch.

As illustrated in the embodiments of FIGS. 2A-2B, the hybrid heat exchanger core 100 may also contain one or more bridging elements 114. The bridging element 114 is shown schematically in FIGS. 2A and 2B, and may have any appropriate configuration, including the ones described further below. As used herein, the term "bridging element" is to be construed broadly and includes, without limitation, individual or corrugated fins, elongate members, foams, porous materials, or other suitable configurations for permitting fluid flow there through. Preferred compositions of the bridging element 114 will be discussed in greater detail below with respect to FIGS. 3A-3B.

In general, the bridging elements 114 interconnect the parting sheets 110*a* and 110*b* within the span 204, bringing the bridging elements 114 into thermal communication with the parting sheets 110*a* and 110*b* and the fluids 106 flowing through the hybrid core 100. In this manner, the bridging elements 114 receive heat from the hot fluid 106*a*, give heat to the cold fluid 106*b*, and transfer heat to the parting sheets 110*a* and 110*b*. The bridging elements 114 also increase the area of the hybrid core 100 in contact with the fluids 106*a* and 106*b*, increasing the heat transferred between the fluids 106*a* and 106*b* flowing through the hybrid core 100. The bridging elements 114 further perform a secondary structural role, supporting thermal and mechanical loads on the joints 116 in a manner similar to that of the enclosure bars 112. By utilizing bridging elements 114 that are possessed of high thermal conductivity and low density, as discussed in detail below with respect to FIGS. 4A-4B, the amount of heat transferred between the fluids 106 by the hybrid core 100 is increased while the weight of the hybrid core 100 is decreased.

As illustrated in the embodiment of FIGS. 2A-B, the bridging elements 114 possess top and bottom faces 222*a* and 222*b*. The bridging elements 114 are preferably dimensioned such that the top and bottom faces 222*a* and 222*b* substantially contact the inner faces 202*a* of the parting sheets 110*a* and 110*b*. The bridging elements are further dimensioned so as to extend at least a portion of the length 210 of the parting sheets 110*a* and 110*b*. The bridging elements 114 are interconnected to the parting sheets 110*a* and 110*b* at points of mutual contact with joints 116. The joints 116 are designed to form a strong bond between the parting sheets 110*a* and 110*b* and the bridging elements 114 which is substantially hermetic, inhibiting fluid leaks, as discussed below in reference to FIG. 4.

Figure 4A:
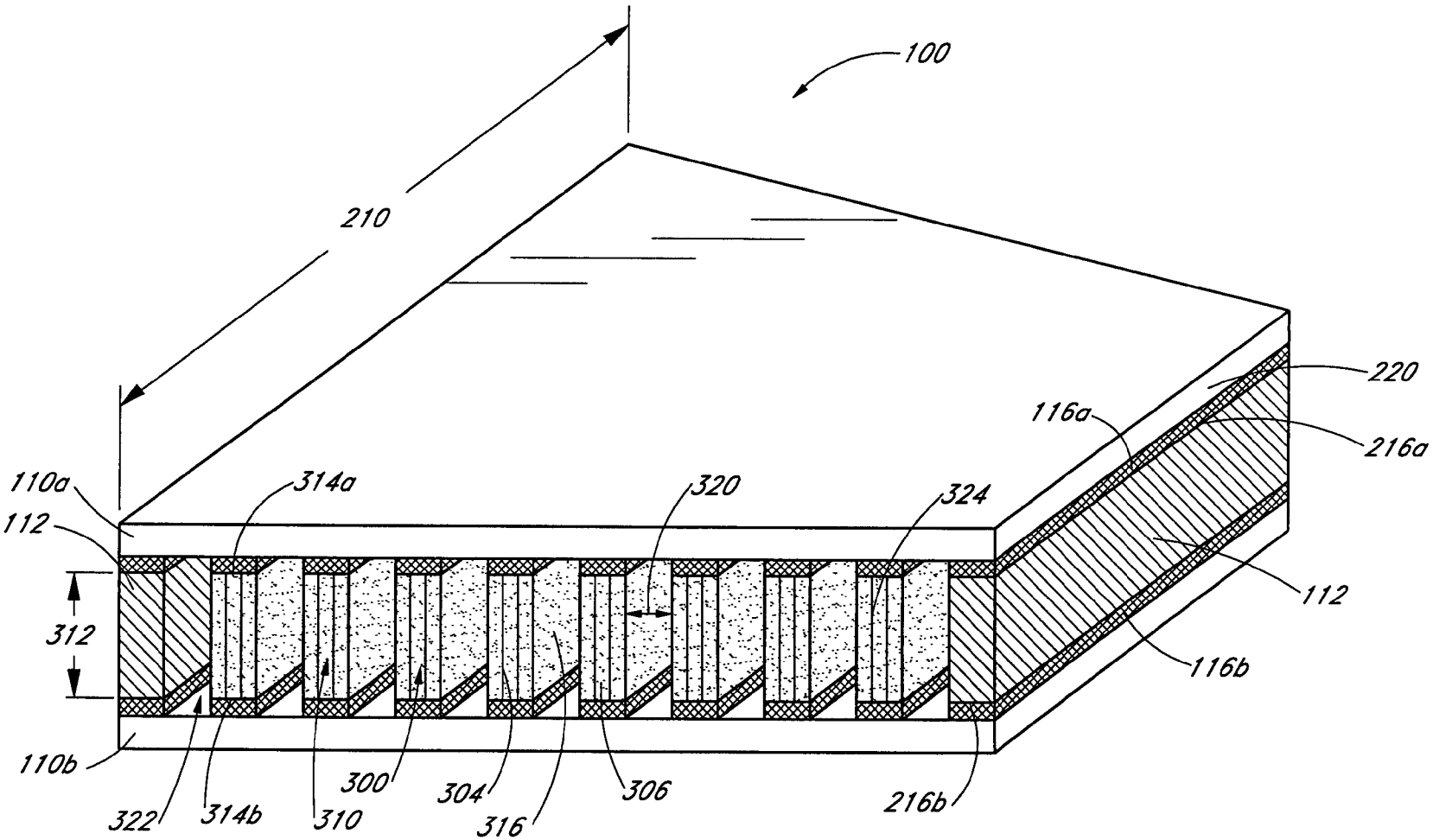
FIGS. 4A-4B illustrate front views of two embodiments of a carbon-based bridging element for a heat exchanger core.
Figure 4B:
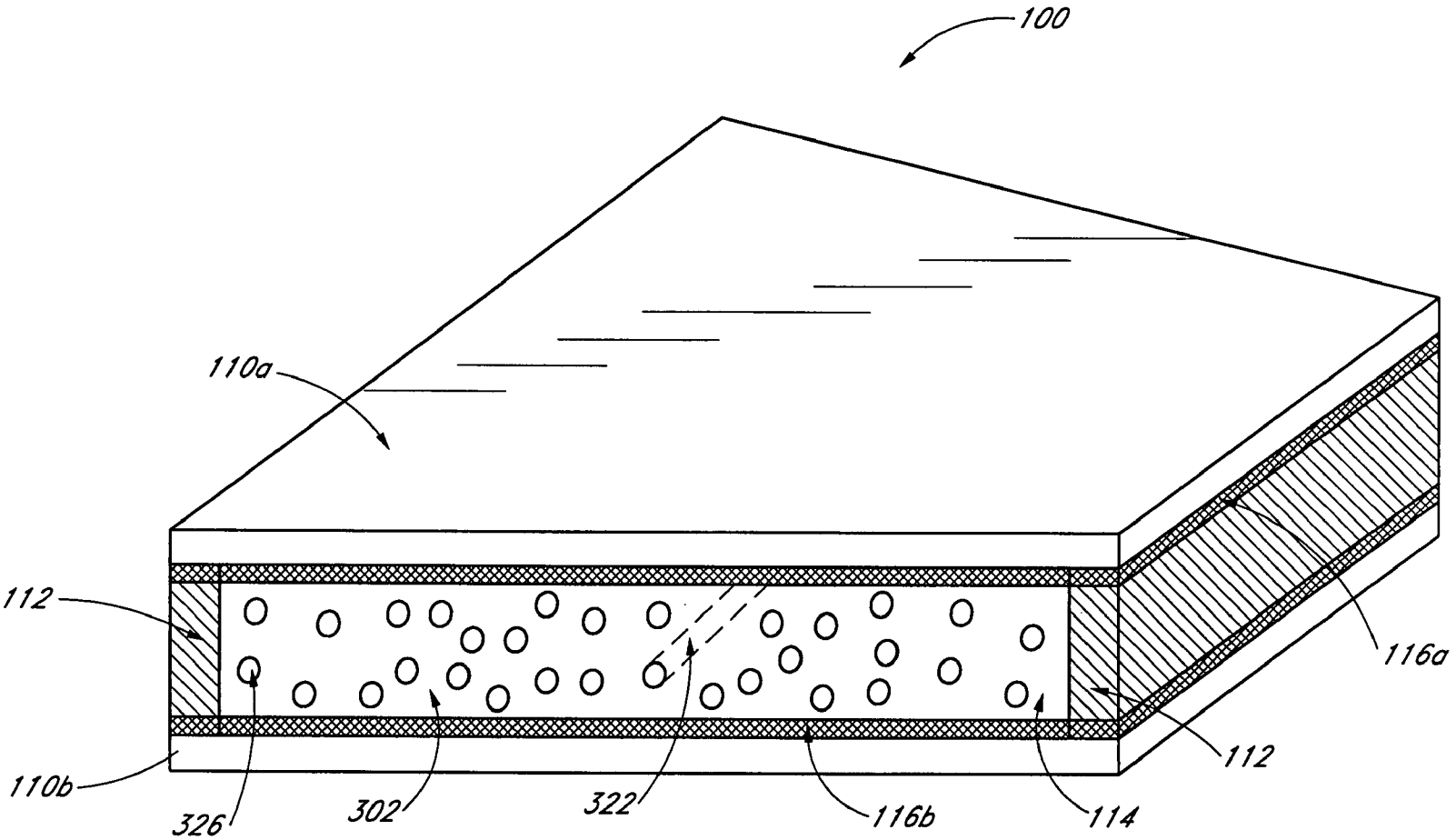

In particular embodiments of the core 100, discussed below with respect to FIGS. 4A-4B, the bridging elements 114 may comprise fiber-reinforced composites 300 (FIG. 4A) or porous foams 302 (FIG. 4B). When composites are used, the composite 300 may comprise a fibrous substrate 304 which is surrounded by a matrix 306. The foam 302, fibers 304, and matrix 306 may comprise any materials which meet the thermal and mechanical demands of the hybrid core 100 and are capable of being bonded to the parting sheets 110*a* and 110*b* with a joint 116 as described in greater detail below. The composite 300, for example, may comprise fibers of carbon, ceramic, particularly SiC, or metal wire in combination with matrices of a polymer, metal, carbon or ceramic in a manner generally understood by those knowledgeable in the art. The foam 302 may comprise porous structures of carbon, metals, and ceramics.

In preferred embodiments, the bridging elements 114 are comprised of carbon based materials. In particular embodiments, the bridging elements 114 comprise carbon fiber/carbon matrix composites (C/C composites) or carbon-based foams. Carbon is desirable, as it possesses a low bulk density, such as between about 1.6 and 2.2 g/cm$^3$, and high thermal conductivity. Selected physical characteristics of the C/C composites and foams are compared to metals and superalloys in TABLE 1 below. TABLE 1 illustrates that C/C composites possess a higher thermal conductivity and a lower density than that of the metals. Additionally, the carbon-based foams provide comparable thermal conductivity to the metals with significantly lower density. These properties translate into greater heat transfer and/or reduced weight for hybrid heat exchanger cores 100 compared to all-metal based cores of the same geometry under identical fluid flow conditions. In addition to these beneficial properties, carbon-based bridging elements 114 further possess greater corrosion resistance than metals and are stable up to operating temperatures of approximately 800° F. or higher, further enhancing the durability of the hybrid exchanger core 100 over all-metallic fabrications.

TABLE 1

| Material | Density (g/cc) | Thermal Conductivity (W/m K) |
|---|---|---|
| METALS | | |
| Aluminum | 2.71 | 190 |
| Titanium | 4.5 | 20 |
| Inconel | 8.2 | 11 |
| CARBON BASED | | |
| C/C Composite | 1.8 | 50-600 |
| Fiber | 2.0-2.2 | 500-1100 |
| Matrix | 1.7-2.2 | 400-2000 |
| C-foam | 0.2-0.5 | 25-140 (Bulk)<br>800-1500 (Ligament) |

In one embodiment, C/C composites used in heat exchangers described herein have low density and high thermal conductivity compared to metals. The exact properties of the C/C composites are a function of the properties of both the fiber 304 and the matrix 306. The density of the carbon matrix 306 may vary approximately between 1.6-2.2 g/cm$^3$ and is preferably approximately 2.0 g/cm$^3$. The well aligned (crystalline) graphite matrix 304 can provide a thermal conductivity of approximately 300-2000 W/m K, more preferably, approximately 600 W/m K. The density of the carbon fiber is typically approximately 1.9 g/cm$^3$, up to about 2.2 g/cm$^3$ with a thermal conductivity from about 300-1100 W/m K.

Furthermore, the volume fraction and orientation of reinforcing fiber 304 influences the properties of the composite. That is to say, increasing the volume of fiber oriented in one direction increases the thermal conductivity in that direction. In one embodiment, the C/C composite 300 possesses a fiber volume fraction of approximately 55-60%, with more of the fiber oriented approximately perpendicular to the parting sheets than in a direction approximately perpendicular thereto. Additional details on the configuration of the C/C composites are discussed below. In preferred embodiments, the composite 300 possesses a thermal conductivity of about 800 W/m K or more, and more preferably about 400 to 1000 W/m K; a low density, preferably in the range of about 1.6 to 2 g/cm$^3$; high Young modulus, preferably up to about 70 to 280 GPa; and a wide operational temperature range, preferably about 273 to 3000 K.

Figure 3A:
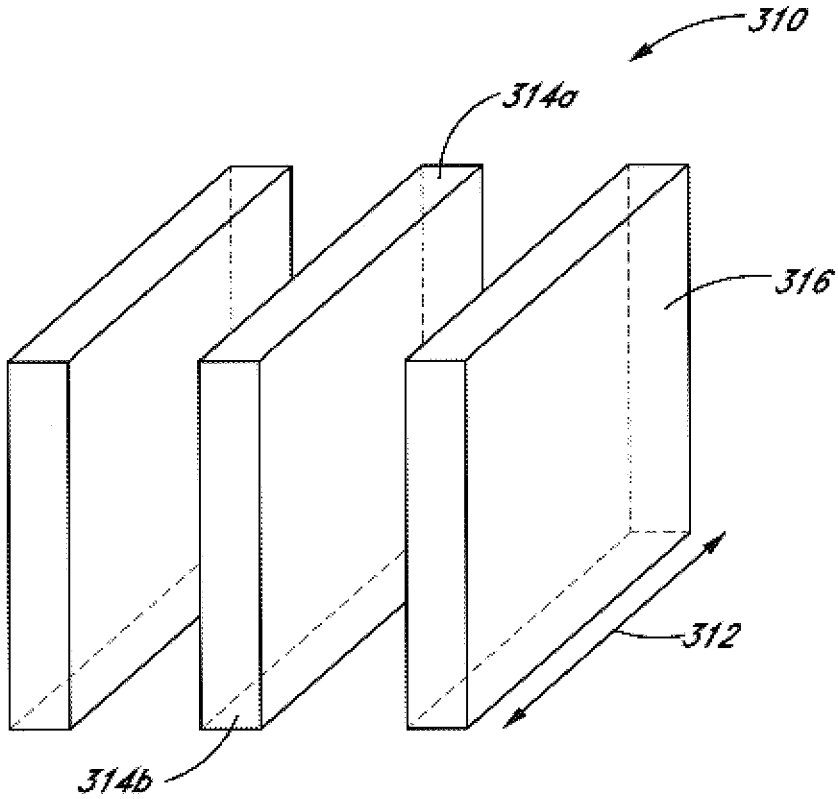
FIGS. 3A-3B illustrate perspective views of two embodiments of bridging element fins.
Figure 3B:
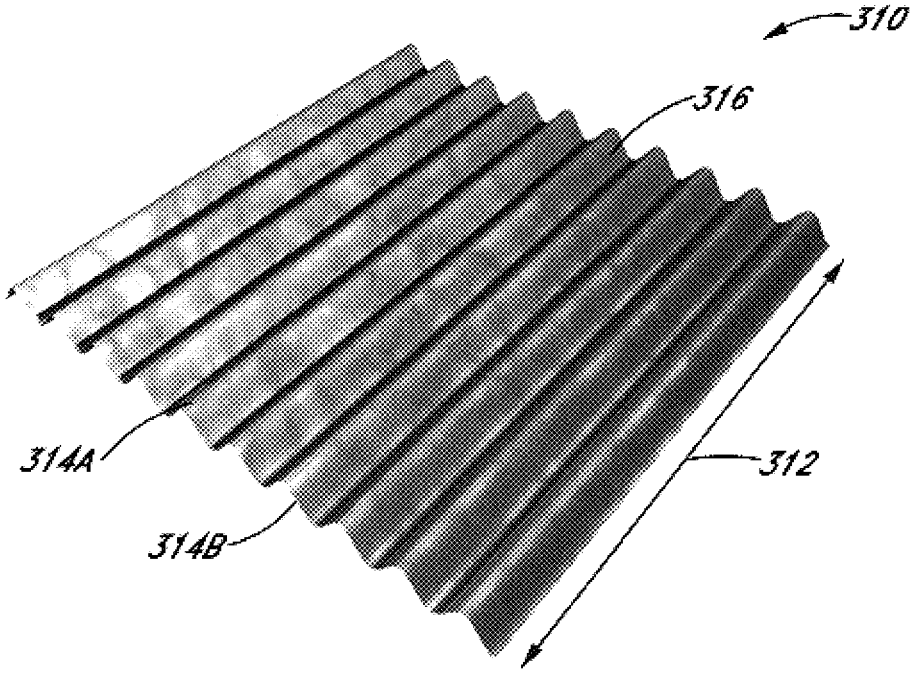

FIGS. 3A and 3B illustrate embodiments of bridging element fins 310, comprising a C/C composite. As used herein, the term "fin" is used as a broad term and includes its ordinary dictionary meaning and also refers to any member possessing a high aspect ratio cross-section. The fins 310 may be a plurality of discrete, substantially straight members (FIG. 3A). Alternatively, the fins may be provided as part of a corrugated sheet, such as shown in FIG. 3B. In such an embodiment, each of the fins is defined between a plurality of bends in the corrugated sheet.

FIG. 4A shows fins 310 incorporated into the hybrid core 100. The fins 310 extends along at least a portion of the length 210 of the parting sheets 110*a* and 110*b*, substantially parallel to the sides 220 of the parting sheet 110*a* and 110*b*. A plurality of fins 310 are placed at predetermined intervals 320 along the width 212 of the parting sheets 110*a* and 110*b*, within the span 204 of the parting sheets 110*a* and 110*b*. The fins 310 have a height 312 approximating the spacing between the parting plates 110, interconnected at upper and lower ends 314*a* and 314*b*. In one embodiment, each fin is a rigid, rectangular plate-like member having a height 312 of between about 0.1 and 1.0 inches, more preferably between about 0.25 and 0.6 inches, a thickness of between about 5 to 20 mils, more preferably about 10 mils, and a length of about 6 to 12 inches.

The fins may be spaced apart from each other at a distance of about 10-40 fins/inch, more preferably about 15-25 fins/inch. When interconnected to the parting sheets 110*a* and 110*b*, the fins 310 define channels 322 which define the direction of fluid flow within the layer 122 of the hybrid core 100. Advantageously, the broad faces 316 of the fin 310 function to increase the area of the hybrid core 100 in contact with the fluids 106*a* and 106*b* and present a large area with which to transfer heat between the fluids 106*a* and 116*b* flowing through the hybrid core 100.

The fins 310 preferably comprise heat flow enhancers 324 that promote heat transfer enhancement through the fin 310. In embodiments of fins 310 comprising fiber reinforced composites, illustrated in FIG. 4A, the heat transfer enhancers 324 comprise the fibers 304 embedded within the matrix 306. More particularly, in embodiments of the fins 310 comprising C/C composites, the heat transfer enhancers 324 comprise carbon fibers. The carbon fibers may have a substantially elevated thermal conductivity compared to the composite matrix 306. In some embodiments, the fibers 304 can be substantially continuous and oriented within the composite 300 so to achieve heat flow in a desired orientation within the composite fin 310. Suitable low density, high conductivity fibers may include, but are not limited to, K1100 fibers (Cytec Industries) as well as lower-cost graphitizable fibers from Cytec (P30X) and Mitsubishi (K321).

In certain embodiments the composite fin 310 is configured with a majority of the fibers 304 aligned substantially perpendicular to the parting sheets 110*a* and 110*b* (the fin direction). This orientation provides a high conductivity pathway for heat flow through the fin 310 to the parting sheets 110*a* and 110*b*, increasing the rate of heat transfer along the direction of the fiber 304. In alternative embodiments, the fibers 304 are oriented along the long axis of the fin 310 (the lateral direction) as dictated by the thermal and mechanical design of the hybrid heat exchanger 100. Where the majority of the fibers are provided perpendicular to the parting sheets or in the fin direction, this "directional" C/C composite yields a lower modulus and higher coefficient of thermal expansion in the lateral direction of the fin.

Advantageously, composite fins constructed with the fibers substantially aligned in the fin direction possess a coefficient of thermal expansion closer to that of the metal parting sheets than typical C/C composites, as the metal parting sheets have a higher coefficient of thermal expansion than typical C/C composites. In one advantage, reducing the thermal expansion mismatch between the fins and parting sheets makes it easier to braze the dissimilar materials, as described further below. In another advantage, the hybrid core may be more reliable, as thermal stresses arising from thermal expansion mismatch are reduced, lessening the probability of thermally induced fatigue failure.

In one particular embodiment, the C/C composite fin 310 is about 5-15 mil thick, more preferably about 14 mil thick, and reinforced with either P30X or K1110 fiber. The thermal conductivity in the fiber direction is between about 200 (P30X) and 500 W/m K (K1110), more preferably about 280 W/M K, and in the non-fiber direction is about 5 to 50 W/m K. In this configuration, about 10-25 fins are deployed per inch.

In a second particular embodiment, the C/C fin 310 is approximately 10 mil thick and reinforced with P30X fiber. Approximately 66 volume % of the fiber 304 is oriented in the fin direction and approximately 34 volume % of the fiber 304 is aligned substantially parallel to the long axis of the fin 310. In this configuration, the conductivity and elastic modulus of the composite fin 310 in the fin direction is approximately 240 W/mK and approximately 330 GPa, respectively.

One embodiment of a C/C composite fin possesses the following properties:

| | |
|---|---|
| Density = | 1.75 g/cm$^3$ |
| Tensile Modulus = | 54 Msi |
| Tensile Strength = | 84 ksi |
| Compressive Modulus = | 60 Msi |
| Compressive Strength = | 29 ksi |
| Thermal Conductivity: | 396 W/m K in the fin direction |
| | 45 W/m K in the lateral direction |
| | 21 W/m K in the thickness direction |

it will be appreciated that in one embodiment a rigid fin will have a density of between about 1.4 g/cm$^3$ and 1.9 g/cm$^3$, a tensile modulus of between about 10 and 60 Msi, and a tensile strength of between about 20-90 ksi. Conductivity may be between about 50 to 450 W/m·K in the fin direction, about 20 to 200 W/m·K in the lateral direction, and about 5-50 W/m·K in the thickness direction.

Figure 5:
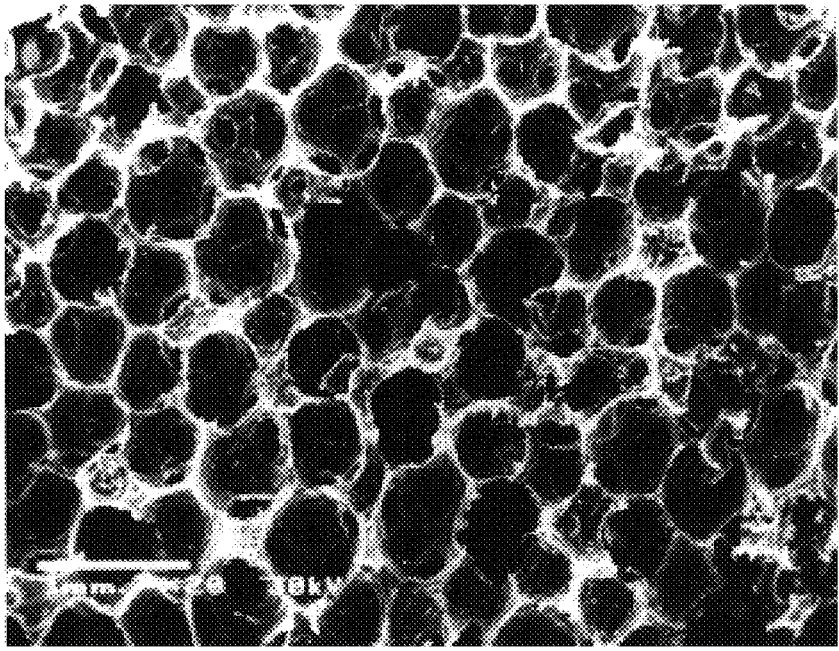
FIG. 5 is a scanning electron micrograph of a carbon-based foam illustrating the open pore structure of the foam.

FIG. 4B presents another embodiment of a heat exchanger core 100 comprising a porous foam bridging element 114, more preferably comprising a carbon-based foam 302. Carbon foam is preferably an open pore foam compound comprised substantially of carbon-based materials. Carbon foams offer a large surface area and a high heat transfer coefficient for improved thermal performance. Preferred embodiments of the foam 302 include reticulated vitreous carbon (RVC) foam, and mesophase foam. FIG. 5 illustrates a scanning electron micrograph of one embodiment of a carbon foam 302, illustrating the open, porous framework characteristic of the foam 302.

RVC foam is an open pore foam material comprising a vitreous carbon skeleton. RVC is a glass-like form of carbon which possesses relatively low density, in one embodiment about 3% solid or 97% voids by volume, high surface area, low resistance to fluid flow, is thermally insulating, and can withstand high temperatures of approximately 3000° F. in non-oxidizing environments. Additionally, RVC foam is available in a wide range of pore size grades, ranging for example from about 5 to 1000 pores per inch.

Figure 6A:
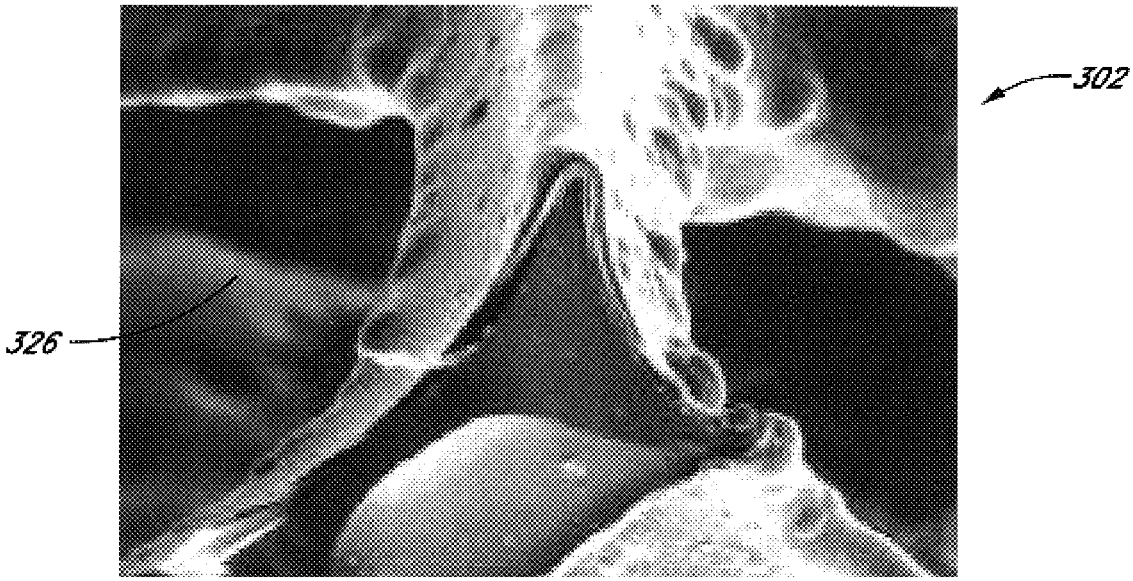
FIGS. 6A-6B are scanning electron micrographs of a reticulated vitreous carbon foam, illustrating the highly oriented structure of the chemical vapor deposited carbon layer.
Figure 6B:
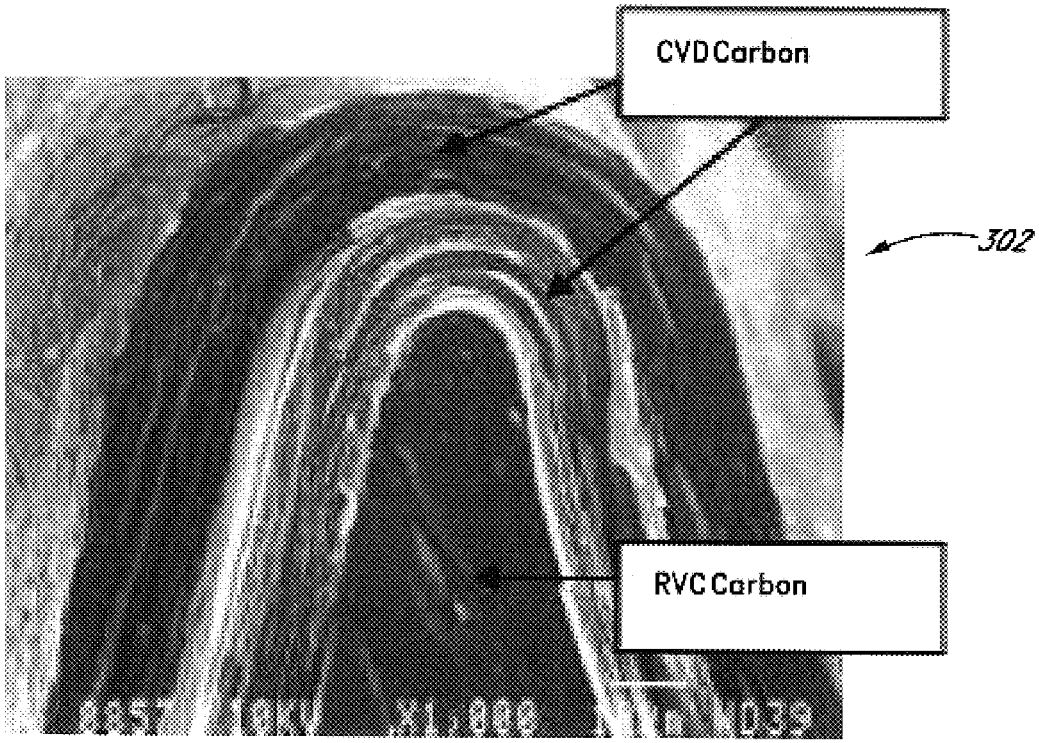

The RVC foam in a preferred embodiment is modified to improve the thermal conductivity. The modified RVC is fabricated by depositing layers of highly oriented carbon onto the ligaments of the glassy carbon surface, as illustrated in FIGS. 6A-6B. The carbon may be deposited using techniques which may include, but are not limited to, pulsed laser deposition, vacuum arc deposition, sputtering, ion beam deposition, pitch impregnation, and chemical vapor deposition (CVD). In a preferred embodiment, CVD is utilized. After deposition, the density of the RVC foam is increased from approximately 0.05 to 0.2 g/cc. The amount of carbon deposited is typically less than about 10% by volume, maintaining the open pore network for fluid flow. Upon high temperature graphitization, the oriented carbon becomes highly thermally conductive in the crystalline layer.

One embodiment of RVC foam has a density of between about 0.05 to 0.3 g/cm$^3$, more preferably about 0.20 g/cm$^3$, and a bulk thermal conductivity of about 10-50 W/m K, more preferably about 10-30 W/m K. In another embodiment, foam may be selected having a density of between about 0.1 to 0.5 g/cm$^3$, more preferably about 0.2 to 0.5 g/cm$^3$ and a thermal conductivity of about 10-150 W/m K, more preferably about 25 to 140 about W/m K. The foam may have a thickness of about 0.33 inch in one embodiment, and a porosity between about 60% and 90%, more preferably about 80% or more. The foam may be bonded to metal parting sheets as described above in a hybrid heat exchanger embodiment, or in alternative, non-hybrid embodiments, the foam bridging element may be bonded to a C/C composite parting sheet, for example using a braze joint 404, described in greater detail below. In further alternative embodiments, the modified RVC foam can also be bonded to aluminum parting sheets using conductive adhesives or low temperature soldering processes.

In certain embodiments, a phase changing material (PCM) is added to the RVC foam. In a preferred embodiment, the PCM comprises a wax. In this configuration, the foam is designed to spread heat absorbed by the core substantially quickly and uniformly throughout the phase changing material. In response, the PCM absorbs a large amount of heat, changing phase from solid to liquid at approximately the same time. In this manner, the PCM acts as a heat storage component, allowing the core to absorb significantly more heat than would be possible in its absence.

The modified RVC foam may be utilized in a wide variety of applications. In one embodiment, the RVC foam is a core material in a multiple-layer cross-flow or counter-flow heat exchanger, as defined in greater detail below with respect to FIGS. 8 and 9. In another embodiment, the RVC foam is the core material in a cold-plate—single layer heat exchanger where a hot component is placed on one face of the heat exchanger and the component is cooled by the flowing liquid inside the heat exchanger. In a further embodiment, the RVC foam is a replacement for pin fins in a finned heat sink used on hot computer chips. The RVC foam may be cooled by air or liquid that flows through the RVC foam, in either an open or closed system. In an additional embodiment, the RVC foam is the core for a thermal storage unit where a PCM is used. In this case, heat is transferred to the PCM material uniformly through the conductive ligament.

In an alternative embodiment, the C-based foam 302 comprises a mesophase carbon foam. This foam is produced from mesophase pitch and can be fully graphitized to yield a structure possessing high thermal conductivity (e.g., up to about 210 W/m K or more). Table 2 below illustrates the properties of mesophase carbon foams produced by two manufacturers, MER Corporation and POCO Graphite, as a function of pore size.

TABLE 2

| Property | MER | MER | MER | MER | POCO |
|---|---|---|---|---|---|
| Density (g/cc) | 0.16 | 0.32 | 0.42 | 0.62 | 0.25-0.65 |
| Pore Size (μm) | 127 | 63.5 | 48 | 30-40 | 93 @ 0.54 g/cc |
| Conductivity (W/mK) | 50 | 150 | 180 | 210 | 175 |

The mechanical and thermal properties of the composite fin 310 and foam 302, such as thermal conductivity, coefficient of thermal expansion, and strength, may be specifically tailored for design and performance of the core 100. For example, the thermal expansion coefficient of the carbon-based bridging element 114 may be substantially matched to that of the parting sheet 110*a* and 110*b* to reduce the thermal mismatch stresses experienced by the joint 116 and enhance the durability of the heat exchanger core 100. Modifications to the composite fin 310 and carbon-based foam 302 to tailor their properties may include, but are not limited to, adjustment of the relative volume fractions of fiber 304 and matrix 306 in the composite 300, adjustment of the pore volume, pore size, and pore distribution in the foam 302, and the choice of materials comprising the fiber 304, matrix 306, and foam 302.

Figure 7A:
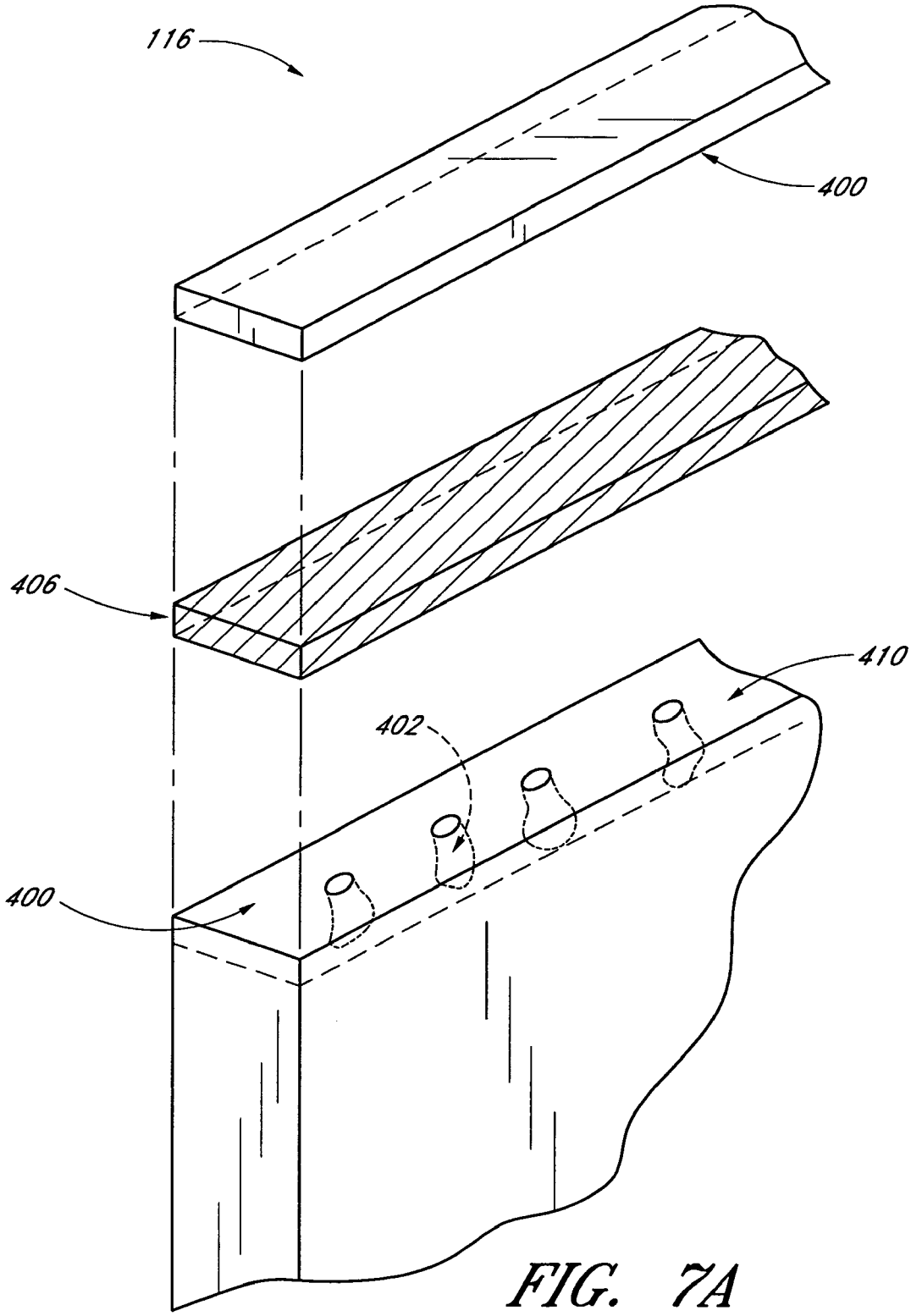
FIGS. 7A-7B illustrate perspective views of a portion of the heat exchanger core, highlighting the joint interconnecting the parting sheets.
Figure 7B:
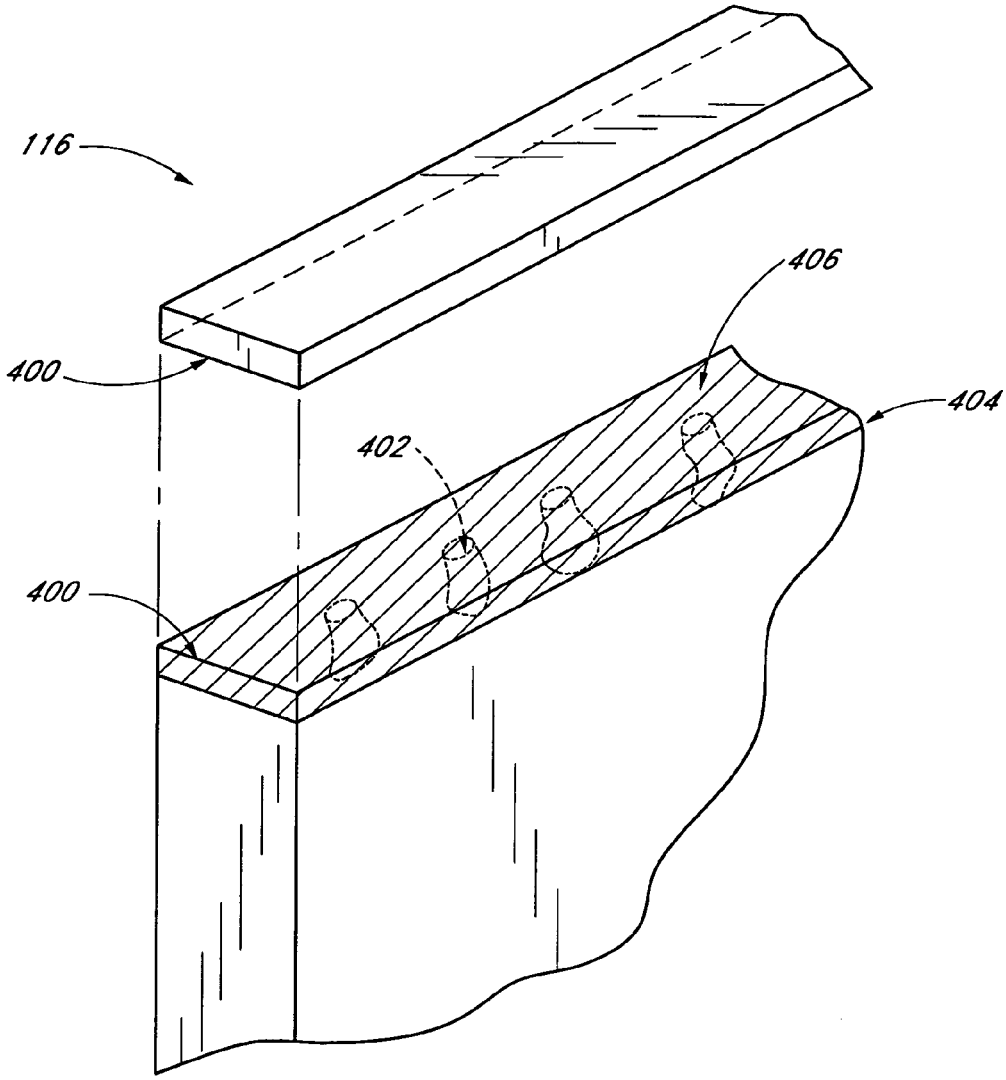

FIGS. 7A-7B illustrate a perspective view of the core 100, illustrating the joint 116. The function of the joint 116 is primarily threefold: to join the core members 120 at points of mutual contact, to form a hermetic seal between the enclosure bar 112 and the parting sheets 110, and to provide good thermal transport between core members 120. FIG. 7A shows an exploded view of the joint 116, illustrating the joint 116 interposed between points of mutual contact of the core members 120. These points of contact will herein be referred to as joint surfaces 400 and may comprise points of contact between any combination of the core members 120. To accomplish these goals, the joint 116 is preferably substantially continuous over the area of the joint surfaces 400, forms a strong bond with the joint surfaces 400, and, preferably, fills in irregularities 402 in the C-based bridging element 114 at the joint surface 400 such as voids, cracks, and other surface features which create a non-planar joint surface 400. In this manner, the core 100 is designed to be mechanically robust as well as inhibit leakage of the fluids from the core 100.

In one embodiment, the joint 116 comprises a brazed joint 404 formed of a metallic braze alloy 406 which is specially tailored to the core members 120 comprising the joint surface 400. The braze alloy 406 is molten and interposed between the close fitting joint surfaces 116 by capillary action. The braze alloy 406 is formulated to melt at a temperature significantly less than the melting points of the core members 120 in order to avoid softening and deformation of these components when the brazing alloy 406 is melted to form the joint 116. The molten braze alloy 406 is additionally designed to "wet" the joint surfaces 400, a process wherein a smooth, continuous layer of the molten braze alloy 406 is achieved over the area of the joint surfaces 400. Preferably in the wetting process, the molten brazing alloy 406 fills in irregularities 402 in the C-based bridging element 114 at the joint surface 400 by capillary action.

The brazing alloy 406 interacts with a thin surface layer 410 of the material comprising the joint surfaces 400 in order to form a bond upon cooling. When bonding metals, a portion of the molten brazing alloy 406 in contact with the joint surface 400 dissolves within the thin surface layer 410 and the metallic joint surface 400. When bonding carbon or ceramics, a metallization layer may be deposited upon the carbon or ceramic joint surface 400. This joint surface 400 interacts with the molten brazing alloy 406 as described above with respect to metal brazing. Alternatively, a portion of the molten brazing alloy 406 in contact with the ceramic or carbon joint surface 400 reacts to form a plurality of compounds within the thin surface layer 410. The brazed joint 404 thus formed is a sandwich of linked layers, each of a different composition. In this fashion, the brazed joint 404 bonds the joint surfaces 400 together. The brazing operation results in an exceptionally strong joint 116 between the brazing alloy 406 and the joint surfaces 400.

Although brazing is described in one preferred embodiment, other methods for joining may be used, such as adhesives or soldering.

As illustrated in FIG. 7B, upon solidification, the braze alloy 406 further forms a joint 116 which is substantially continuous across the area of the joint surfaces 400. Advantageously, the brazed joint 404 between the enclosure bars 112 and parting sheets 110 is substantially impermeable to fluids under pressure and other mechanical loadings. Non-limiting examples of the braze alloy include Cusil ABA for joining Ti alloys to C/C composites and BNi-2 and BNi-5 for joining Ni-based superalloys such as Hastelloy X to C/C. The brazed joint, in one embodiment, is approximately 2 to 6 mils thick.

Figure 8A:
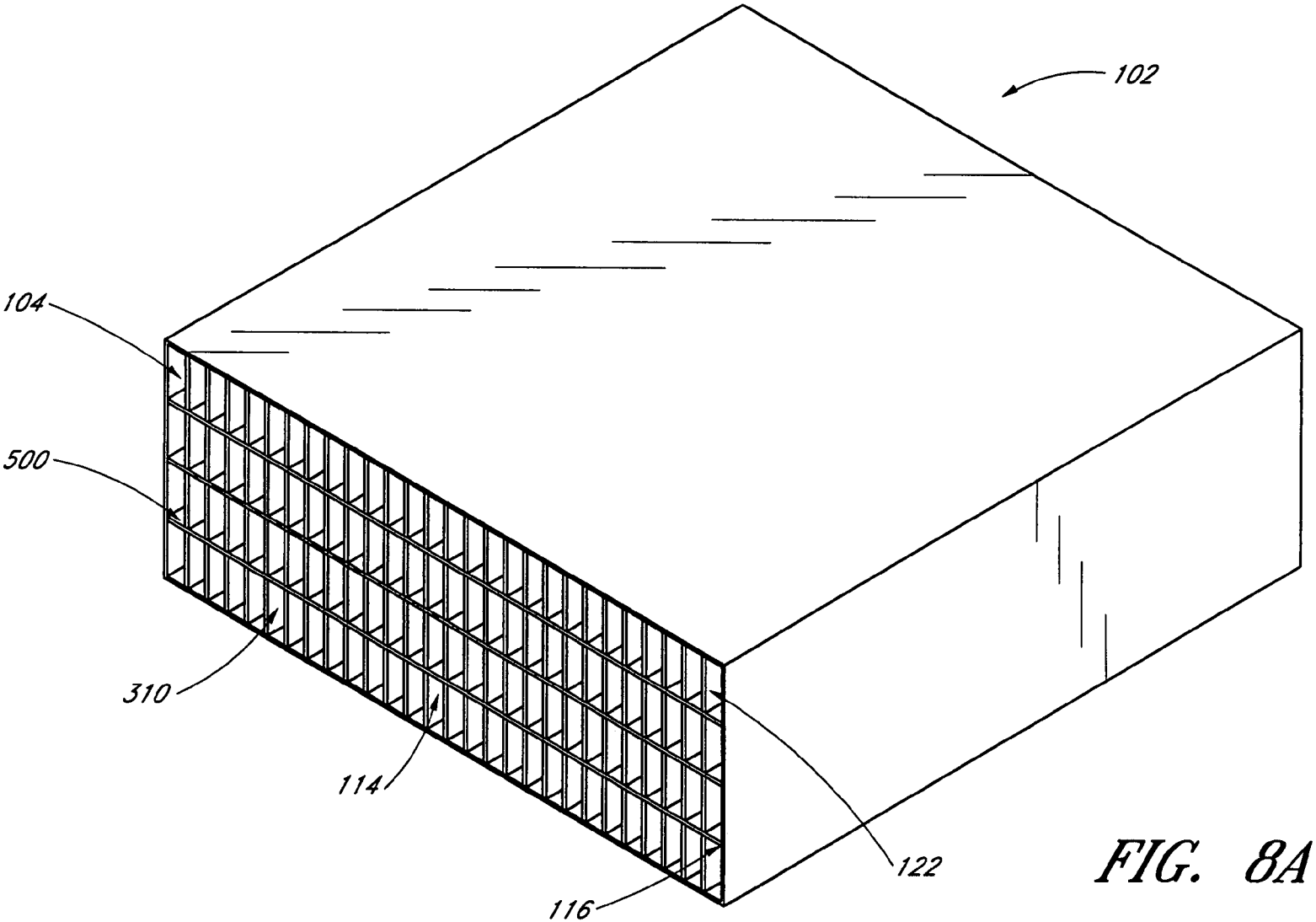
FIGS. 8A-8C illustrate embodiments of bridging element configurations in a heat exchanger core.
Figure 8B:
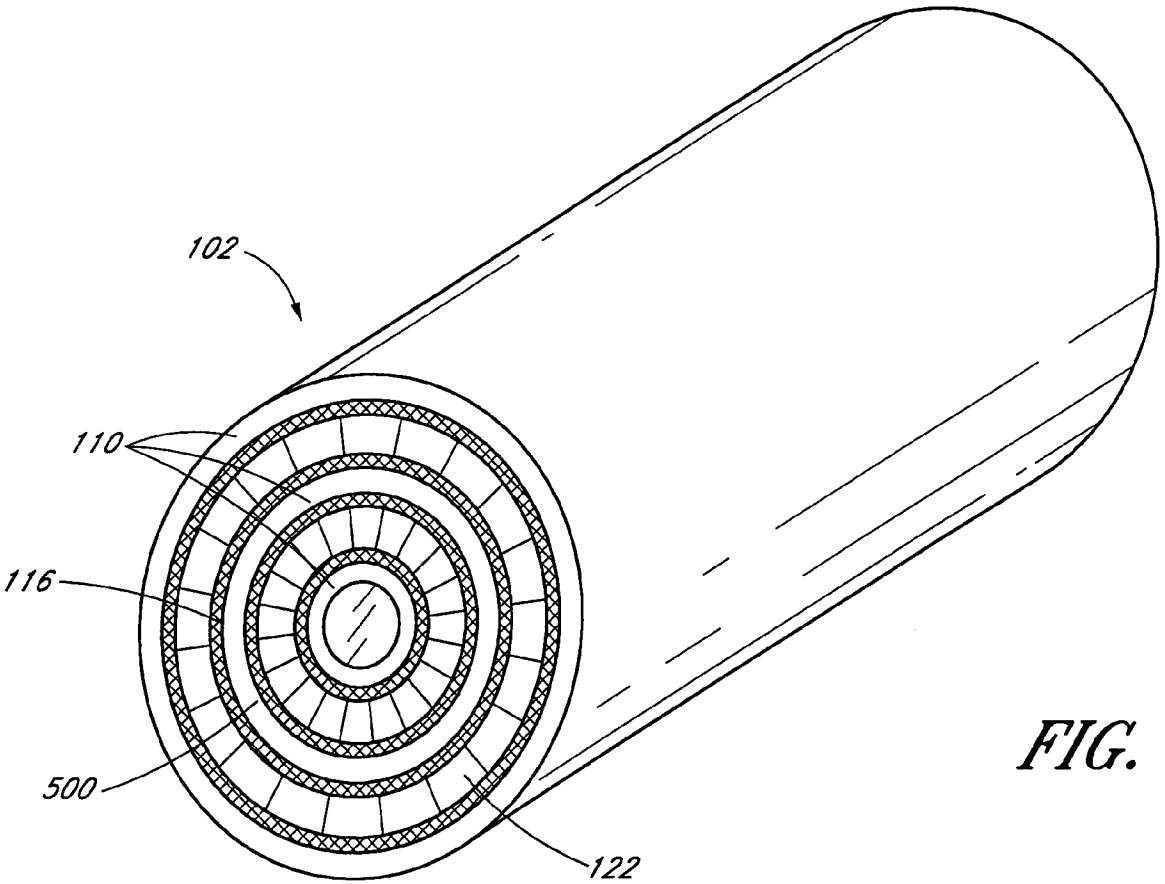
Figure 8C:
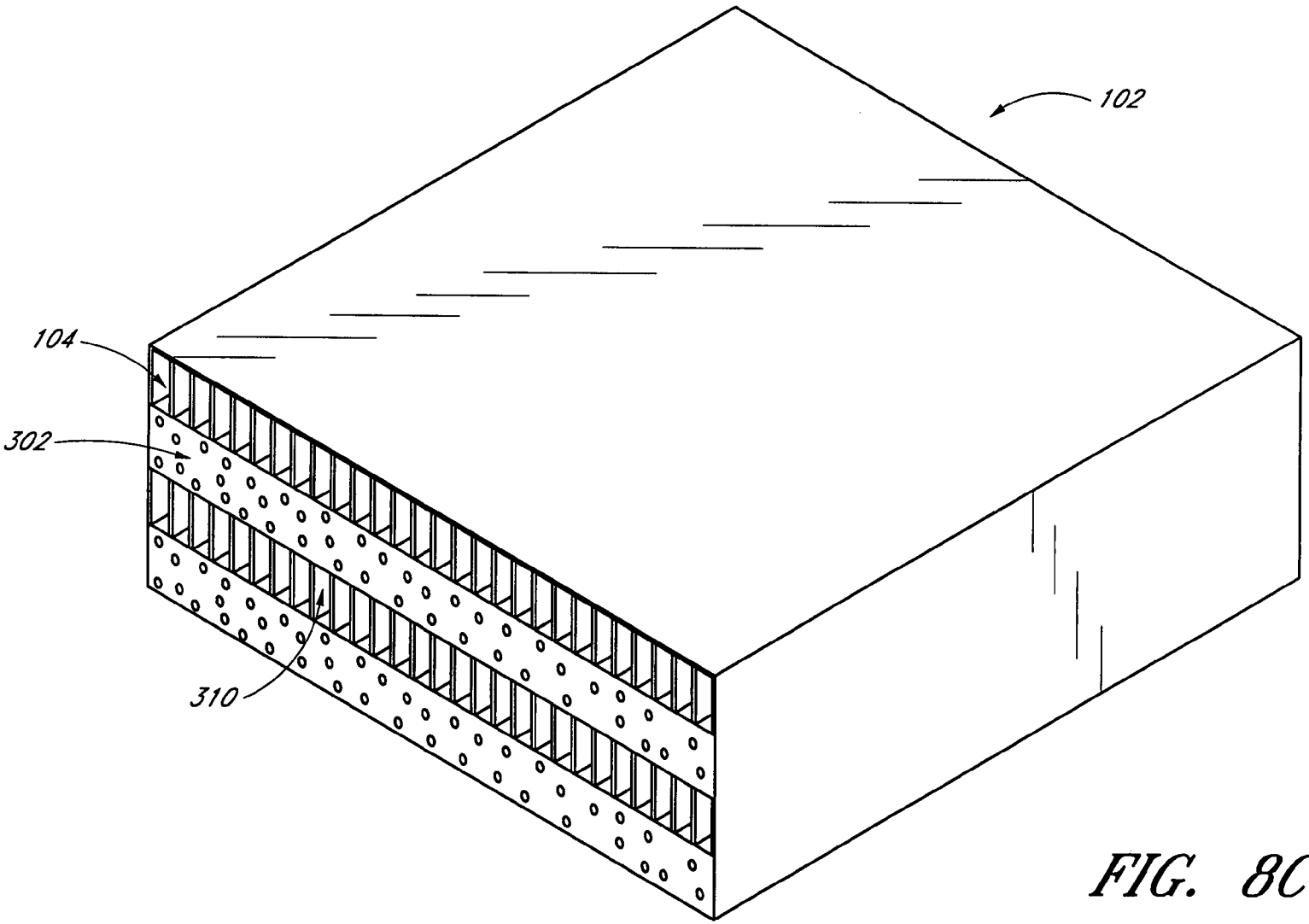

FIGS. 8A-8C illustrate embodiments of multi-layer cores 102. In these embodiments, a plurality of single-layer cores 104 containing aligned bridging elements is layered. As illustrated in FIG. 8A, this may be accomplished in sheet configurations by stacking layers, while in tubular geometries, shown in FIG. 8B, this may be accomplished by nested tubular layers. Each layer 122 of aligned bridging elements 114 is separated by common parting sheet 500. The bridging elements 114 are secured to the common parting sheet 500 by the joint 116, which may comprise a brazed joint 404 as described above in reference to FIGS. 7A-7B. The multi-layer core 102 may be fabricated with a predetermined number of layered, horizontally aligned bridging elements 114 in this fashion. As shown in FIGS. 8A-8B the multi-layer core 102 may employ a single type of bridging element 114, such as composite fins 310 or carbon-based foams 214, or alternatively, the multi-layer core 102 may utilize both fins 310 and foams 302, as illustrated in FIG. 8C.

Figure 9A:
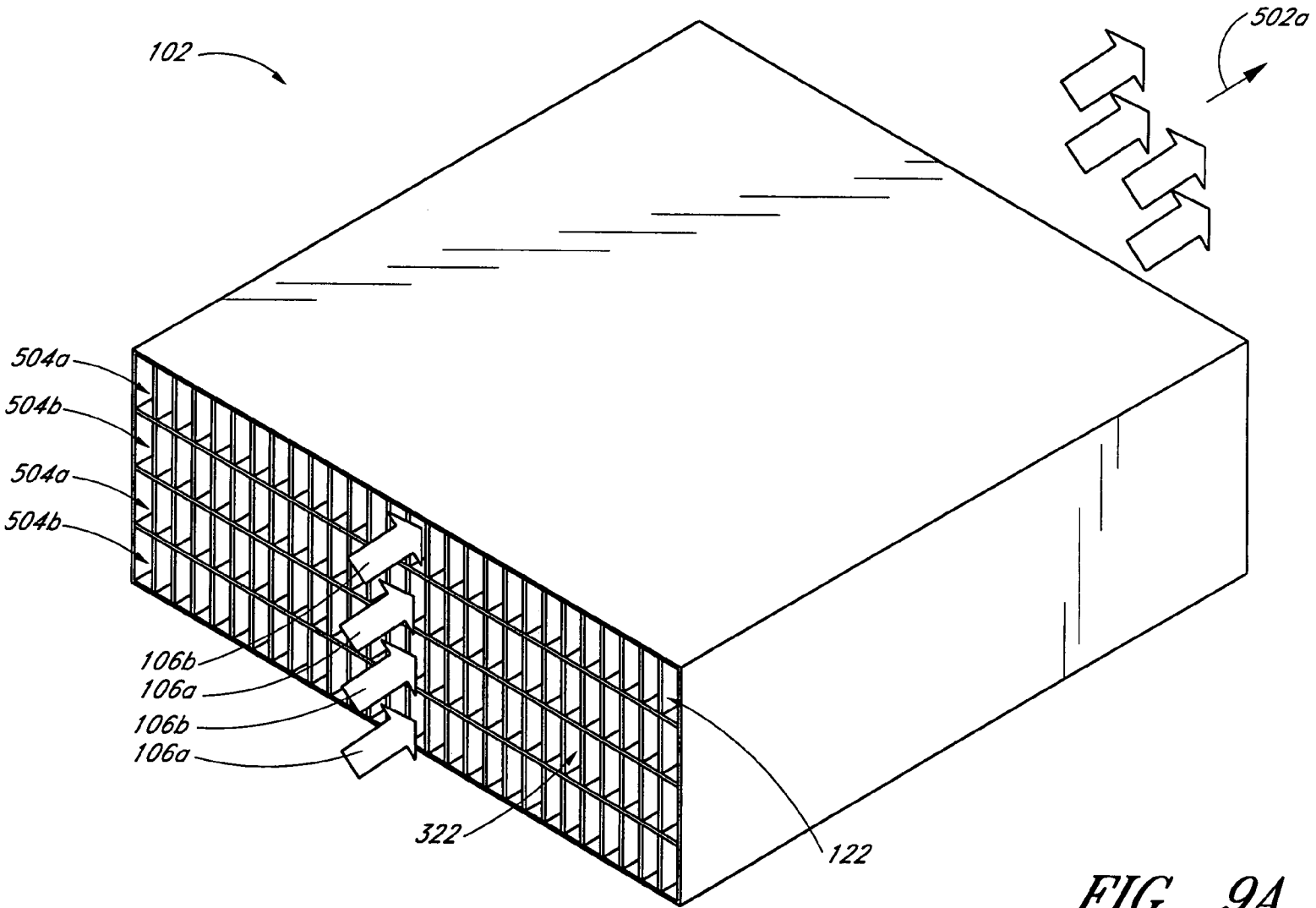
FIGS. 9A-9H illustrate embodiments of fluid flow patterns in a multi-layer, heat exchanger core.
Figure 9B:
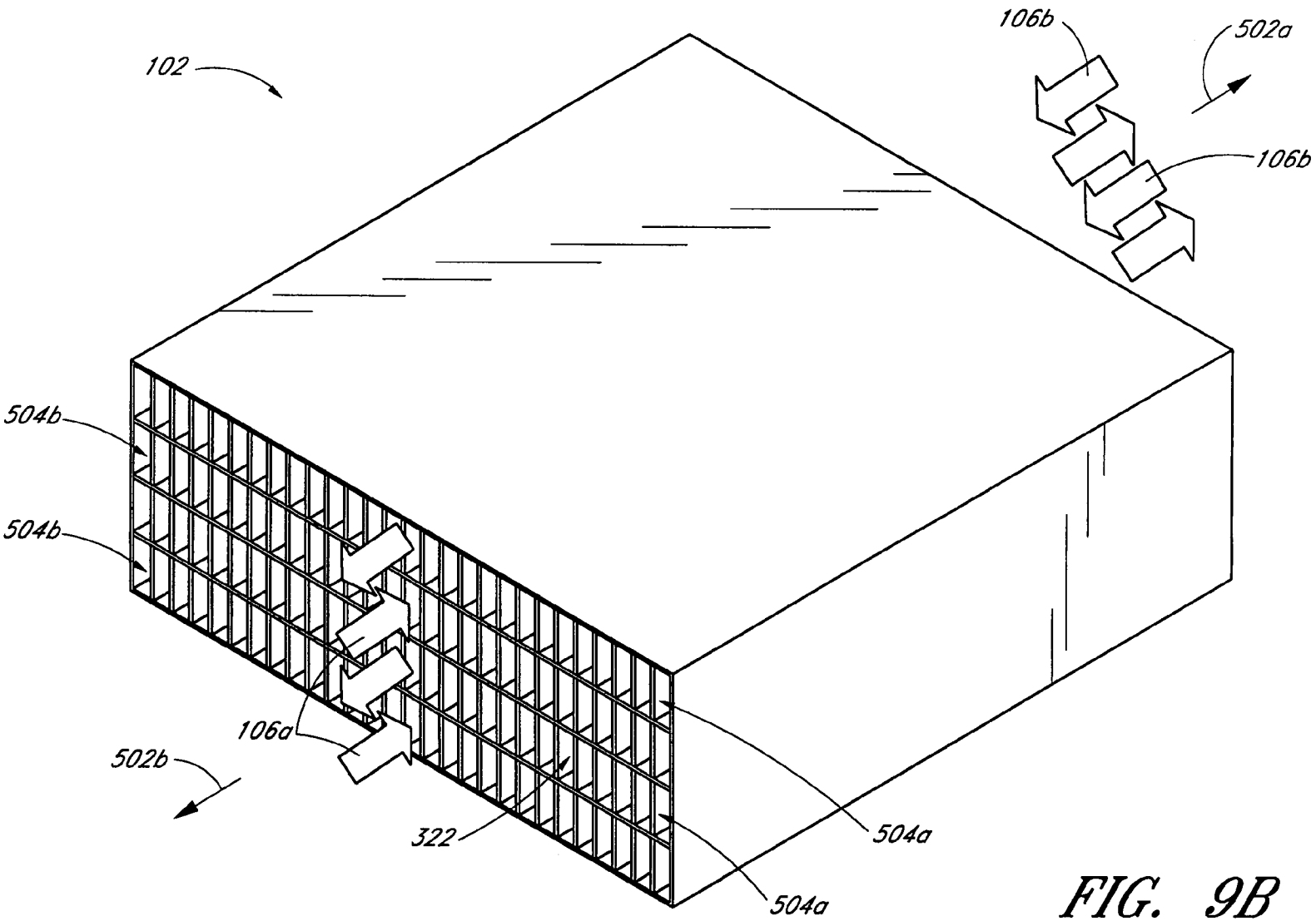
Figure 9C:
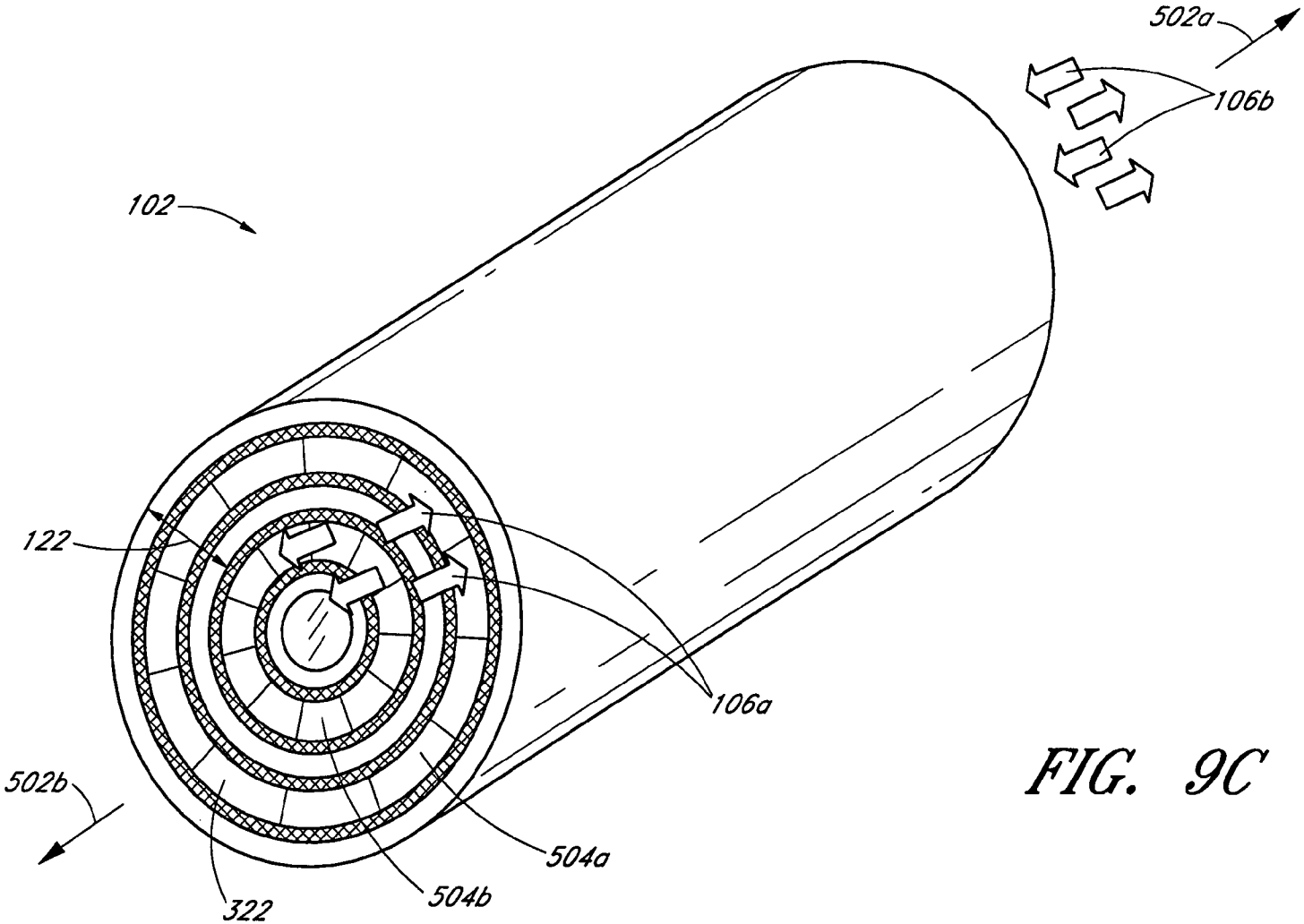
Figure 9D:
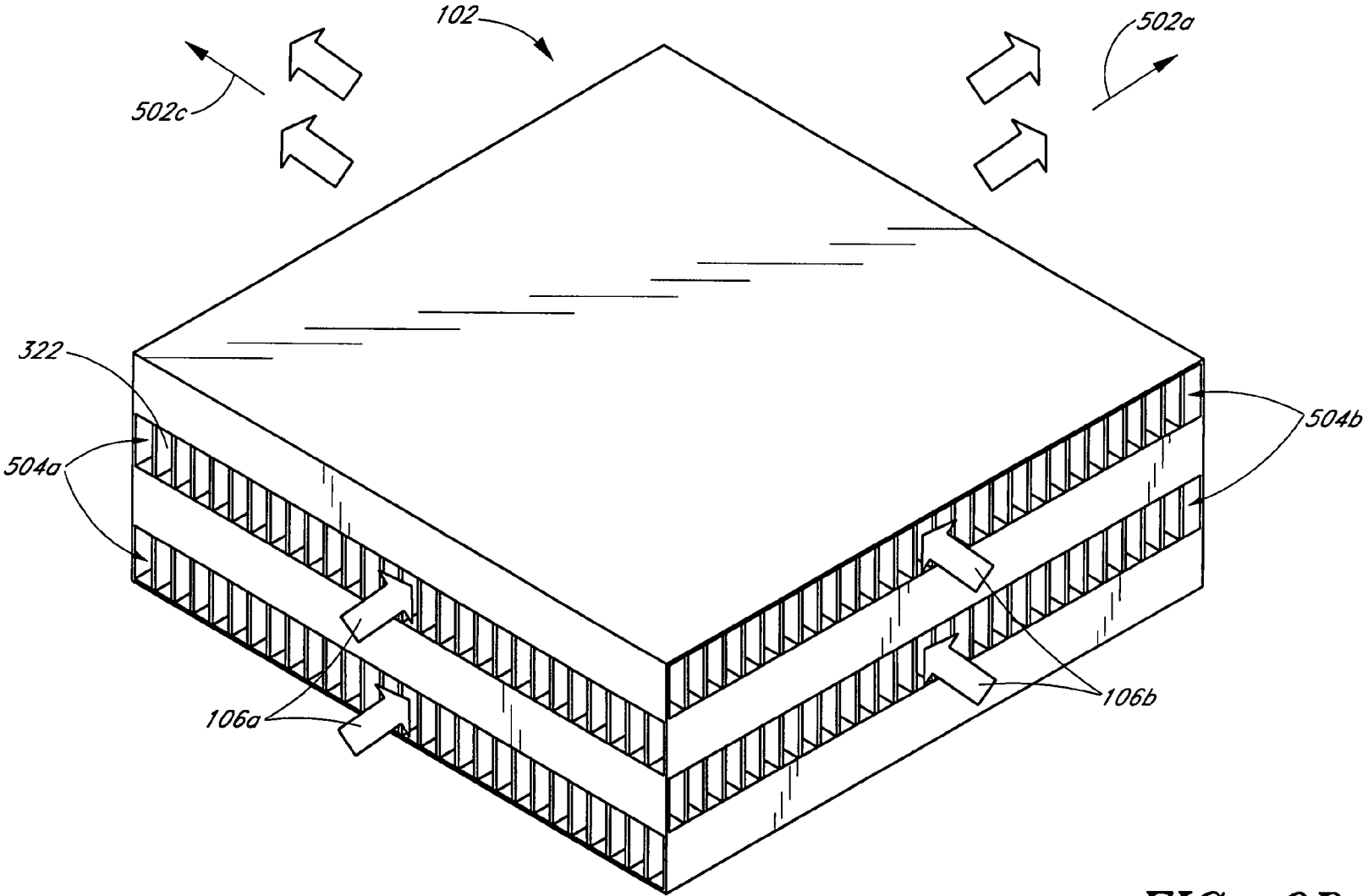
Figure 9E:
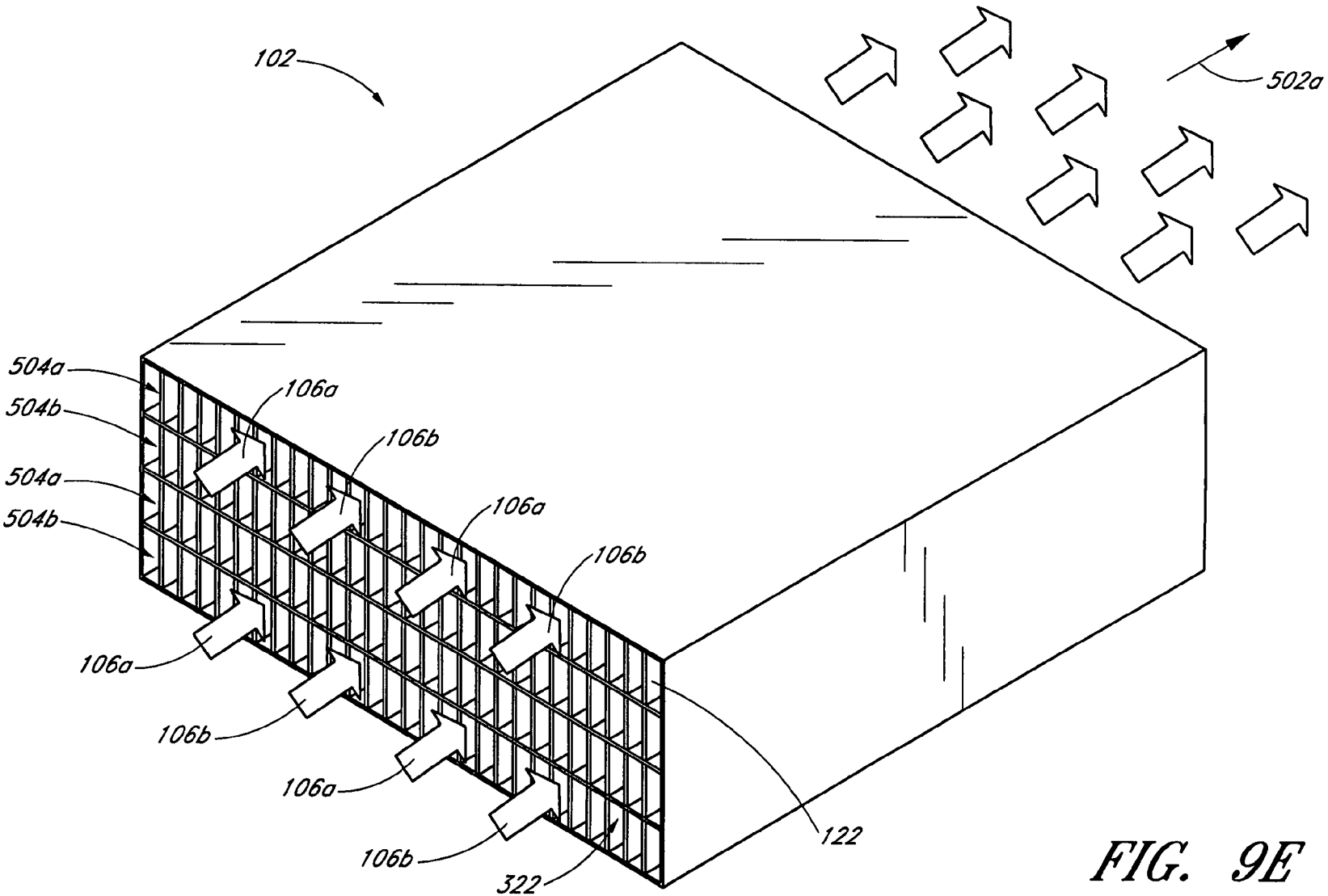
Figure 9F:
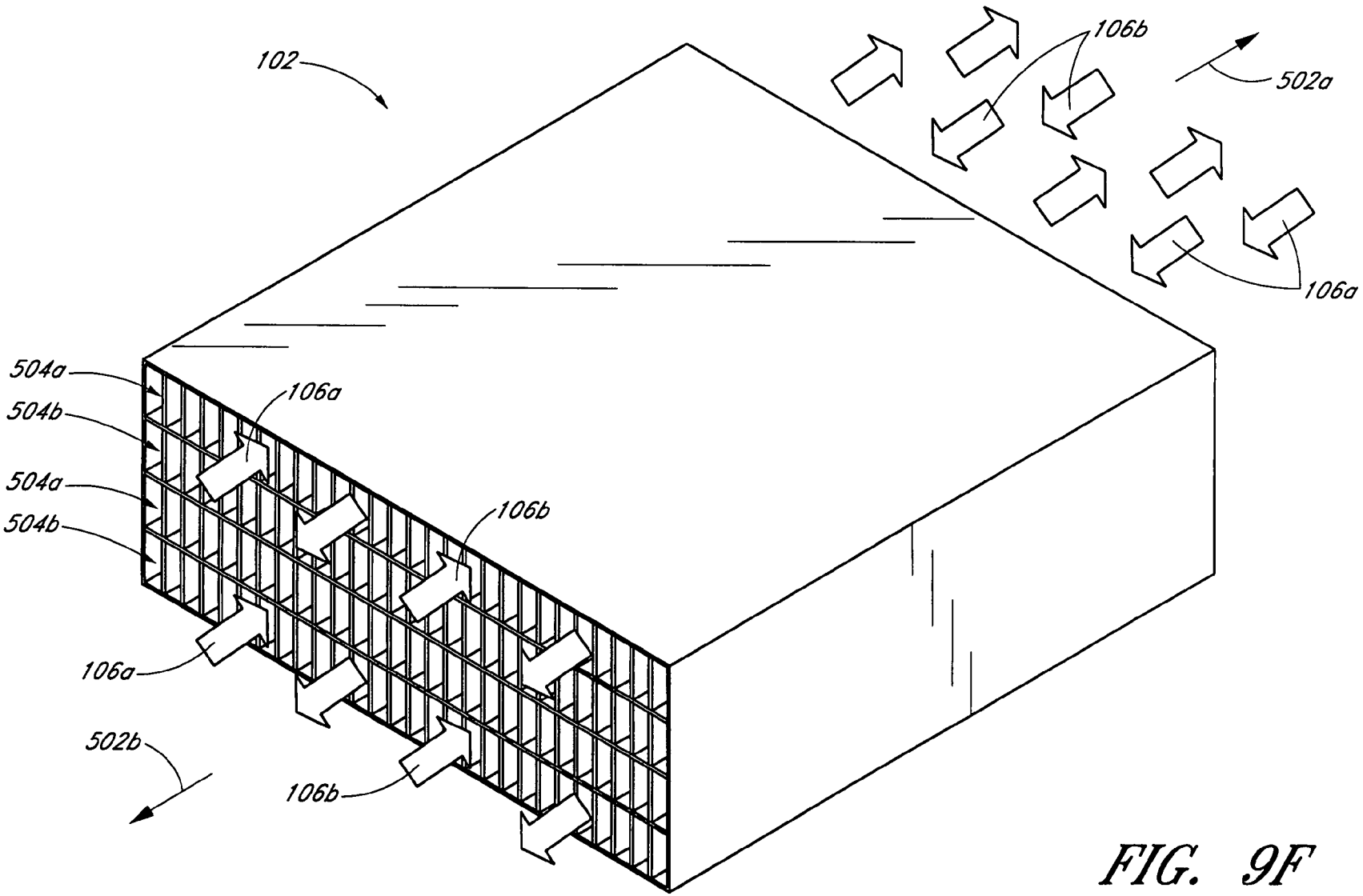
Figure 9G:
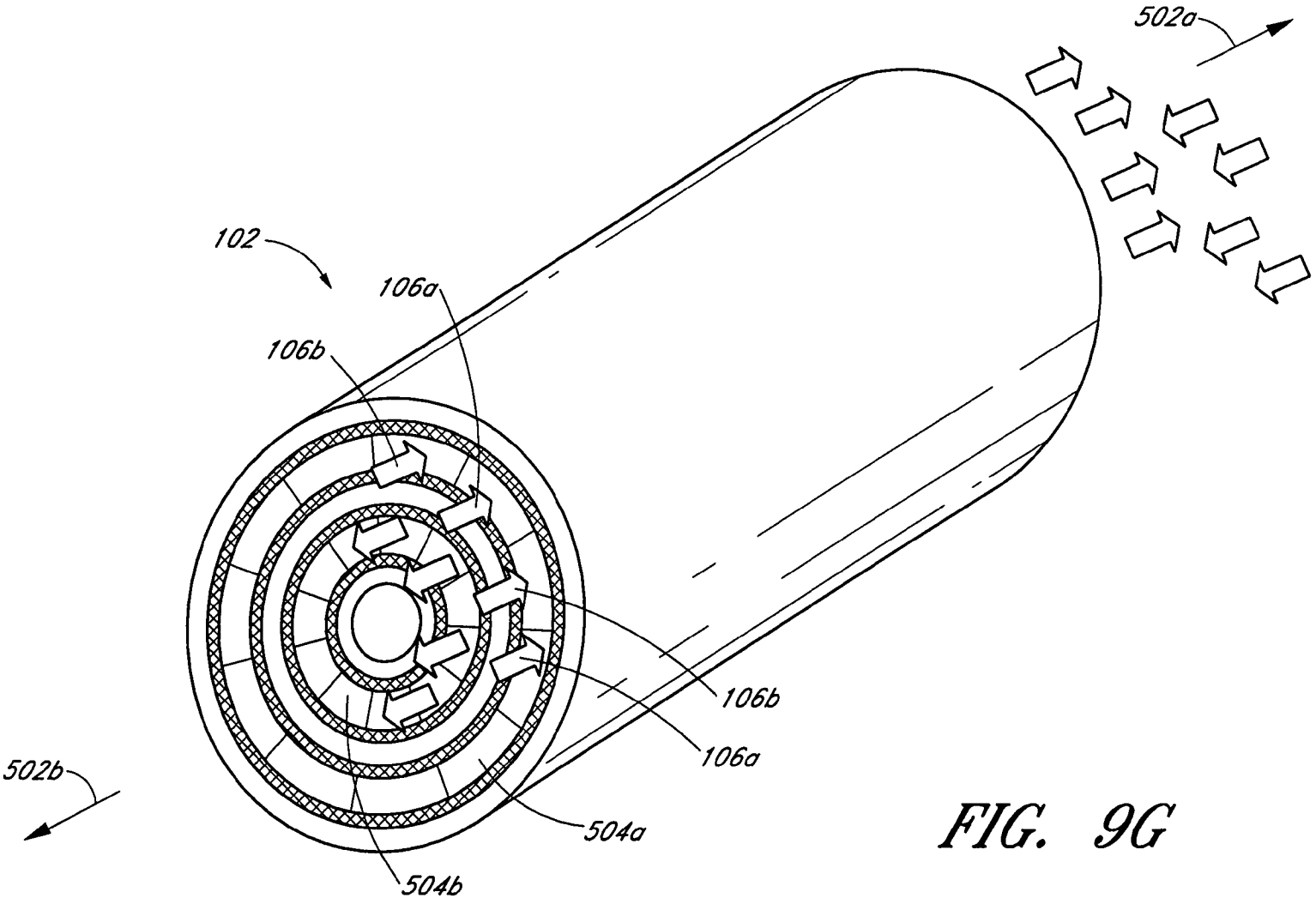
Figure 9H:
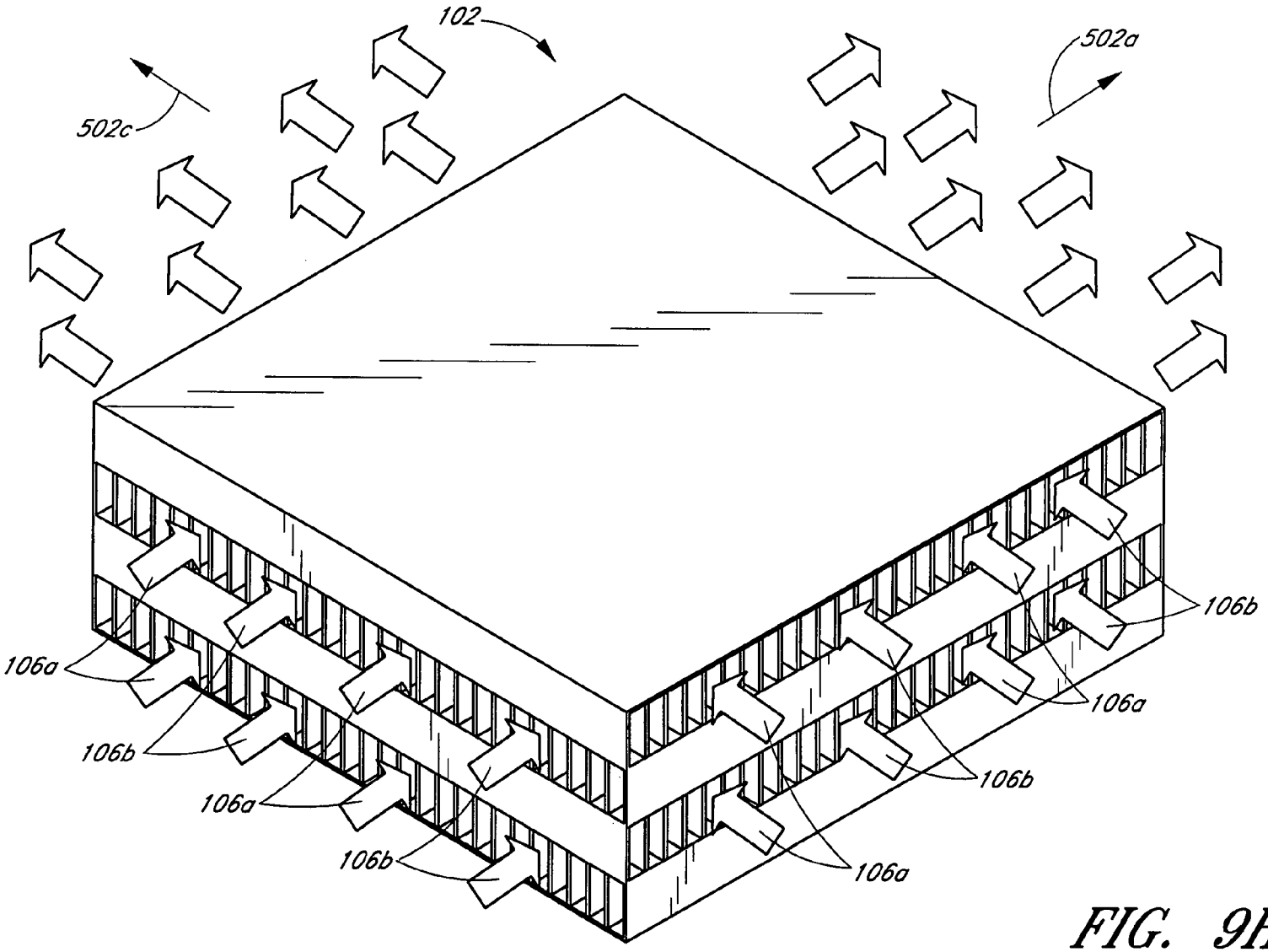

In further alternative embodiments, presented in FIGS. 9A-9H, the direction of fluid flow defined by the channels 322 within the layers 122 of a multi-layer heat exchanger core 100 may be varied. FIG. 9A illustrates a parallel-flow architecture, wherein the hot and cold fluids 106*a* and 106*b* both flow in a first flow direction 502*a*, carried within the channels 322 of a first and a second plurality 504*a* and 504*b* of adjacent layers 122. FIGS. 9B-9C illustrate a counter-flow architecture in flat and tubular configurations. In one fluid, for example the hot fluid 106*a*, flows in the first flow direction 502*a* of FIG. 6A within the first plurality of layers 504*a*, while the other fluid, the cold fluid 106*b* in this example, flows in a second flow direction 502*b*, anti-parallel to the first flow direction 502*a* within the second plurality of layers 504*b*. FIG. 9D illustrates a cross-flow architecture, wherein the channels 322 within the first plurality of layers 504*a* are oriented in the first flow direction 502*a* while the channels 322 within the second plurality of layers 504*b* are oriented in a third flow direction 502*c*, approximately perpendicular to the first flow direction 502*a*. FIGS. 9E-H further illustrate parallel-flow, counter-flow, and cross-flow configurations adapted such that flow of the hot and cold fluids 106*a* and 116*b* occurs within adjacent channels 322 of the same layer 122.

FIG. 10 illustrates a heat exchanger formed according to one embodiment of the present invention. The heat exchanger 600 may be made according to the embodiments above, and in one embodiment, comprises C/C fins and nickel-based alloy parting plates. More preferably, the heat exchanger 600 may comprise a C/C/Hastelloy X heat exchanger core and four Hastelloy headers. The illustrated heat exchanger includes six cold flow layers and six hot flow layers and may be about 10 inches long, about 4.25 inches wide, and about 6.5 inches high. C/C fins used may be about 0.015" thick and about 0.5" high. The Hastelloy X parting sheets may be about 0.018" thick, and the side bars are about 0.5" high and about 0.125" thick. The top and bottom sheets of the heat exchanger are preferably thicker than the other sheets, and maybe about 0.04" thick. The heat exchanger core is fabricated by the multiple brazing approach described above, and the headers are attached to the recuperator core by welding.

FIG. 11 illustrates different heat exchanger cores, two being single layer and two being three layer. As illustrated, the single layer and three layer cores may be about 4"×2"× "0.52" and 4"×2"×1.56", respectively. In one embodiment, the heat exchanger cores utilize titanium parting sheets that are about 0.010" thick, with enclosure bars that are about 0.125" thick. Two to three mils of Cusil ABA foil may be used for brazing.

Although the foregoing description has shown, described, and pointed out the fundamental novel features of the present teachings, it will be understood that various omissions, substitutions, and changes in the form of the detail of the apparatus as illustrated, as well as the uses thereof, may be made by those skilled in the art, without departing from the scope of the present teachings. Consequently, the scope of the present teachings should not be limited to the foregoing discussion, but should be defined by the appended claims.

What is claimed is:

1. A hybrid heat exchanger core, comprising:

a plurality of substantially parallel metallic parting sheets, each having a first and a second face, wherein opposing faces of the metallic parting sheets are separated by a span which defines a passageway for fluid flow; and a rigid carbon-based bridging element interposed within the span between adjacent metallic parting sheets, wherein the rigid carbon based bridging element defines channels for fluid flow;

wherein the carbon-based bridging element is joined to the metallic parting sheets with a brazed joint, wherein the brazed joint forms a mutual contact between the metallic parting sheet and the carbon-based bridging element in order to mechanically secure the metallic parting sheet to the carbon-based bridging element.

2. The hybrid heat exchanger core of claim 1, wherein the metallic sheets comprise a titanium alloy.

3. The hybrid heat exchanger core of claim 2, wherein the brazed joint comprises Cusil ABA.

4. The hybrid heat exchanger core of claim 1, wherein the metallic sheets comprise a nickel-based superalloy.

5. The hybrid heat exchanger core of claim 4, wherein the brazed joint is selected from the group consisting of BNi-2 and BNi-5.

6. The hybrid heat exchanger core of claim 1, wherein the carbon-based bridging element comprises a plurality of carbon fiber/carbon matrix composite fins.

7. The hybrid heat exchanger core of claim 6, wherein carbon fibers are oriented in the fins substantially unidirectionally.

8. The hybrid heat exchanger core of claim 6, wherein carbon fibers are oriented in the fins substantially perpendicular to the parting sheets.

9. The hybrid heat exchanger core of claim 1, further comprising a plurality of metallic enclosure bars spanning between adjacent metallic parting sheets.

10. The hybrid heat exchanger core of claim 9, wherein the enclosure bars are secured to the parting sheets with brazed joints to provide hermetic seals and increased structural support.

11. The hybrid heat exchanger core of claim 1, wherein alternating layers of metallic parting sheets and carbon-based bridging elements are stacked together and secured by brazed joints to form a stacked hybrid heat exchanger.

12. A hybrid heat exchanger core, comprising:

a plurality of metallic parting sheets possessing a first face and a second face and arranged substantially parallel to one another; and a plurality of carbon/carbon composite fins provided between adjacent metallic parting sheets, each fin oriented substantially perpendicular or at an angle to the adjacent metallic parting plates and defining channels therebetween for fluid passage.

13. The hybrid heat exchanger core of claim 12, further comprising brazed joints connecting the fins to the metallic parting sheets.

14. The hybrid heat exchanger core of claim 12, wherein the fins comprise carbon fibers oriented substantially unidirectionally and substantially perpendicular to the parting sheets.

15. The hybrid heat exchanger core of claim 12, wherein the fins are discrete plates.

16. The hybrid heat exchanger core of claim 12, wherein the fins form part of a corrugated sheet.

17. The hybrid heat exchanger core of claim 12, comprising at least 3 metallic parting sheets.

18. The hybrid heat exchanger core of claim 12, comprising at least 4 metallic parting sheets.

19. The hybrid heat exchanger core of claim 12, wherein a first set of fins defines channels extending in a first direction and a second set of fins defines channels extending in a second direction, the first direction and the second direction being substantially perpendicular to one another.

20. The hybrid heat exchanger core of claim 12, wherein the fins are spaced apart at about 10 to 40 fins per inch.

* * * * *

UNITED STATES PATENT AND TRADEMARK OFFICE

CERTIFICATE OF CORRECTION

PATENT NO. : 7,331,381 B2
APPLICATION NO. : 11/356337
DATED : February 19, 2008
INVENTOR(S) : Wang et al.

It is certified that error appears in the above-identified patent and that said Letters Patent is hereby corrected as shown below:

On the Title Page, Item (57) (Abstract)

Line 8 - After "which" delete "forms".

On the Title Page, Item (56) (Other Publications)

Line 3 - Delete "oml.gov" and insert -- ornl.gov --, therefor.

On the Title Page Item (56) Page 2, (Other Publications)

Line 5 - Delete "oml.gov" and insert -- ornl.gov --, therefor.

Column 2

Line 6 - After "exchangers" insert -- . --.

Column 6

Line 49 - After "the parting" delete "parting". (Repeated Occurrence)

Column 10

Line 18 - Delete "W/M K," and insert -- W/m K, --, therefor.

Line 44 (Approx.) - Delete "it" and insert -- It --, therefor.

Signed and Sealed this

Twenty-ninth Day of July, 2008

JON W. DUDAS
*Director of the United States Patent and Trademark Office*